US009153242B2

(12) United States Patent
Yamanashi et al.

(10) Patent No.: US 9,153,242 B2
(45) Date of Patent: Oct. 6, 2015

(54) ENCODER APPARATUS, DECODER APPARATUS, AND RELATED METHODS THAT USE PLURAL CODING LAYERS

(75) Inventors: Tomofumi Yamanashi, Kanagawa (JP); Toshiyuki Morii, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 818 days.

(21) Appl. No.: 13/505,634

(22) PCT Filed: Nov. 12, 2010

(86) PCT No.: PCT/JP2010/006665

§ 371 (c)(1),
(2), (4) Date: May 2, 2012

(87) PCT Pub. No.: WO2011/058758

PCT Pub. Date: May 19, 2011

(65) Prior Publication Data

US 2012/0221344 A1 Aug. 30, 2012

(30) Foreign Application Priority Data

Nov. 13, 2009 (JP) ..... 2009-259949

(51) Int. Cl.

| | |
|---|---|
| ***G10L 21/00*** | (2013.01) |
| ***G10L 19/00*** | (2013.01) |
| ***G10L 19/24*** | (2013.01) |
| ***G10L 19/02*** | (2013.01) |

(52) U.S. Cl.

CPC ..... *G10L 19/24* (2013.01); *G10L 19/0204* (2013.01)

(58) Field of Classification Search

USPC ..... 704/500

See application file for complete search history.

(56) References Cited

U.S. PATENT DOCUMENTS

| | | | | |
|---|---|---|---|---|
| 5,115,469 | A * | 5/1992 | Taniguchi et al. | 704/228 |
| 7,966,175 | B2 * | 6/2011 | Xie | 704/229 |

(Continued)

FOREIGN PATENT DOCUMENTS

| | | |
|---|---|---|
| JP | 2009-042740 | 2/2009 |
| WO | 2008/072670 | 6/2008 |

(Continued)

OTHER PUBLICATIONS

Sanjeev Mehrotra, Low Bitrate audio coding using generalized adaptive gain shape vector quantization across channels, May 2009, ICASSP IEEE, pp. 9-12.*

(Continued)

*Primary Examiner* — David Hudspeth
*Assistant Examiner* — Timothy Nguyen
(74) *Attorney, Agent, or Firm* — Greenblum & Bernstein, P.L.C.

(57) ABSTRACT

A coding apparatus is provided that improves the quality of a decoded signal in a hierarchical coding (scalable coding) scheme in which a coding target band is selected in each hierarchy (layer). The coding apparatus includes a first layer coding section that selects a first quantization target band of inputted spectrum and generates first layer coded information including first band information of the selected band. An adder generates a first layer difference spectrum using a first decoded signal generated using the first layer coded information and the inputted spectrum. A second layer coding section generates second layer coded information including second band information of the selected band, wherein first layer coding section determines a method of quantizing the gain of the inputted spectrum from a plurality of candidates based on the first band information and second band information.

26 Claims, 16 Drawing Sheets

(56) References Cited

U.S. PATENT DOCUMENTS

| | | | | |
|---|---|---|---|---|
| 8,554,549 | B2 | 10/2013 | Oshikiri et al. | |
| 2003/0093271 | A1* | 5/2003 | Tsushima et al. | 704/230 |
| 2005/0010396 | A1* | 1/2005 | Chiu et al. | 704/200.1 |
| 2005/0163323 | A1* | 7/2005 | Oshikiri | 381/22 |
| 2005/0165611 | A1* | 7/2005 | Mehrotra et al. | 704/500 |
| 2007/0016427 | A1* | 1/2007 | Thumpudi et al. | 704/500 |
| 2008/0126085 | A1* | 5/2008 | Morii | 704/222 |
| 2008/0262835 | A1* | 10/2008 | Oshikiri | 704/205 |
| 2009/0175550 | A1* | 7/2009 | Taleb | 382/253 |
| 2009/0234644 | A1* | 9/2009 | Reznik et al. | 704/203 |
| 2010/0017204 | A1 | 1/2010 | Oshikiri et al. | |
| 2010/0169081 | A1 | 7/2010 | Yamanashi et al. | |
| 2010/0274558 | A1 | 10/2010 | Yamanashi et al. | |
| 2013/0325457 | A1 | 12/2013 | Oshikiri et al. | |
| 2013/0332154 | A1 | 12/2013 | Oshikiri et al. | |

FOREIGN PATENT DOCUMENTS

| | | |
|---|---|---|
| WO | 2009/055493 | 4/2009 |
| WO | 2009/081568 | 7/2009 |

OTHER PUBLICATIONS

Akio Jin et al., "Scalable Audio Coding Based on Hierarchical Transform Coding Modules", Transaction of Institute of Electronics and Communication Engineers of Japan, A, vol. J83-A, No. 3, Mar. 2000, pp. 241-252, (with partial English translation).

Yamanashi et al, "ITU-T G.718—Development of Speech/Audio Codec for Next-Generation Mobile Communication Systems", Panasonic Technical Journal, vol. 55, No. 1, Apr. 2009, pp. 21-26, (with English Abstract).

"ITU-T: G.718 Frame error robust narrow-band and wideband embedded variable bit-rate coding of speech and audio from 8-32 kbit/s", ITU-T Recommendation G.718, Jun. 2008.

Ehara et al, Development of 32 kbit/s scalable wide-band speech and audio coding algorithm using high-efficiency code-excited linear prediction and band-selective modified discrete cosine transform coding algorithms, Journal of the Acoustical Society of Japan, Apr. 1, 2008, vol. 64, No. 4, pp. 196-207.

International Search Report, mailed Feb. 15, 2011, for corresponding International Application No. PCT/JP2010/006665.

* cited by examiner

ENCODER APPARATUS, DECODER APPARATUS, AND RELATED METHODS THAT USE PLURAL CODING LAYERS

TECHNICAL FIELD

The present invention relates to a coding apparatus, a decoding apparatus, and method thereof, which are used in a communication system that encodes and transmits a signal.

BACKGROUND ART

When a speech/audio signal is transmitted in a packet communication system typified by Internet communication, a mobile communication system, or the like, compression/encoding technology is often used in order to increase speech/audio signal transmission efficiency. Also, recently, there is a growing need for technologies of simply encoding speech/audio signals at a low bit rate and encoding speech/audio signals of a wider band.

Various technologies of integrating plural coding technologies in a hierarchical manner have been developed for the needs. For example, Non-Patent Literature 1 discloses a technique of encoding a spectrum (MDCT (Modified Discrete Cosine Transform) coefficient) of a desired frequency band in a hierarchical manner using TwinVQ (Transform Domain Weighted Interleave Vector Quantization) in which a basic constituting unit is modularized. Simple scalable coding having a high degree of freedom can be implemented by common use of the module plural times. In the technique, a sub-band that becomes a coding target of each hierarchy (layer) is basically a predetermined configuration. At the same time, there is also disclosed a configuration in which a position of the sub-band that becomes the coding target of each hierarchy (layer) is varied in a predetermined band according to characteristics of an input signal.

CITATION LIST

Non-Patent Literature

NPL 1

Akio Kami et al., "Scalable Audio Coding Based on Hierarchical Transform Coding Modules", Transaction of Institute of Electronics and Communication Engineers of Japan, A, Vol. J83-A, No. 3, pp. 241-252, March, 2000

NPL 2

ITU-T:G.718; Frame error robust narrowband and wideband embedded variable bit-rate coding of speech and audio from 8-32 kbit/s. ITU-T Recommendation G.718 (2008)

SUMMARY OF INVENTION

Technical Problem

However, in Non-Patent Literature 1 above, for example, in the configuration in which a position of the sub-band that becomes the coding target of each hierarchy (layer) is varied in a predetermined band, the sub-band selected as the coding target differs from one frame to another or from one layer to another. For this reason, there is a problem that it is not possible to apply predictive coding in the time axis direction or apply predictive coding in the layer axis direction as the coding method for frequency parameters of a band (coding target band) of the coding target, resulting in insufficient coding efficiency. As a result, unfortunately the quality of the generated decoded speech becomes insufficient.

It is an object of the present invention to provide a coding apparatus, a decoding apparatus, and methods thereof being able to improve the quality of the decoded signal in the hierarchical coding (scalable coding) scheme in which the band of the coding target is selected in each hierarchy (layer).

Solution to Problem

A coding apparatus of the present invention is a coding apparatus that includes at least two coding layers, including: a first layer coding section that inputs an input signal of a frequency domain thereto, selects a first quantization target band of the input signal from a plurality of sub-bands into which the frequency domain is divided to obtain first band information and obtain a first gain of the input signal of the first quantization target band, generates first coded information including the first band information and first gain coded information obtained by encoding the first gain and generates a difference signal between a decoded signal obtained by performing decoding using the first coded information and the input signal; and a second layer coding section that inputs the difference signal thereto, selects a second quantization target band of the difference signal from the plurality of sub-bands to obtain second band information, and obtains a second gain of the difference signal of the second quantization target band and to generate second coded information including the second band information and second gain coded information obtained by encoding the second gain, wherein: the first layer coding section includes a determination section that determines a method of encoding the first gain from a plurality of candidates based on the first band information.

A coding apparatus of the present invention is a coding apparatus that includes at least two coding layers, including: a first layer coding section that inputs an input signal of a frequency domain thereto, selects a first quantization target band of the input signal from a plurality of sub-bands into which the frequency domain is divided to obtain first band information and obtain a first gain of the input signal of the first quantization target band, generates first coded information including the first band information and first gain coded information obtained by encoding the first gain and generates a difference signal between a decoded signal obtained by performing decoding using the first coded information and the input signal; and a second layer coding section that inputs the difference signal thereto, selects a second quantization target band of the difference signal from the plurality of sub-bands to obtain second band information, and obtains a second gain of the difference signal of the second quantization target band to generate second coded information including the second band information and second gain coded information obtained by encoding the second gain, wherein: at least one of the first layer coding section and the second layer coding section includes a determination section that determines a method of encoding a gain of an input signal to the coding section of the each layer in a quantization target band of each layer from a plurality of candidates based on band information in an own layer or a lower layer.

A decoding apparatus of the present invention is a decoding apparatus that receives and decodes information generated by a coding apparatus including at least two coding layers, including: a receiving section that receives the information including first coded information and second coded information, the first coded information being obtained by encoding a first layer of the coding apparatus, the first coded information including first band information generated by selecting a first quantization target band of the first layer from a plurality of sub-bands into which a frequency domain is divided, the second coded information being obtained by encoding a second layer of the coding apparatus using the first coded information, the second coded information including second band information generated by selecting a second quantization target band of the second layer from the plurality of sub-bands; a first layer decoding section that inputs the first coded information obtained from the information thereto, and generates a first decoded signal with respect to the first quantization target band set based on the first band information; and a second layer decoding section that inputs the second coded information obtained from the information thereto, and generates a second decoded signal with respect to the second quantization target band set based on the second band information, wherein: the first layer decoding section includes a determination section that determines a method of decoding a gain of the first decoded signal from a plurality of candidates based on the first band information.

A coding method of the present invention is a coding method including at least two coding layers, including: a first layer encoding step of inputting an input signal of a frequency domain thereto, selecting a first quantization target band of the input signal from a plurality of sub-bands into which the frequency domain is divided to obtain first band information, while obtaining a first gain of the input signal of the first quantization target band, generating first coded information including the first band information and first coded information obtained by encoding the first gain, and generating a difference signal between a decoded signal obtained by performing decoding using the first coded information and the input signal; and a second layer encoding step of inputting the difference signal, selecting a second quantization target band of the difference signal from the plurality of sub-bands to obtain second band information, while obtaining a second gain of the difference signal of the second quantization target band and generating second coded information including the second band information and second gain coded information obtained by encoding the second gain, wherein: the first layer encoding step includes a determining step of determining a method of encoding the first gain from a plurality of candidates based on the first band information.

A decoding method of the present invention is a decoding method for receiving and decoding information generated by a coding apparatus including at least two coding layers, including: a receiving step of receiving the information including first coded information and second coded information, the first coded information being obtained by encoding a first layer of the coding apparatus, the first coded information including first band information generated by selecting a first quantization target band of the first layer from a plurality of sub-bands into which a frequency domain is divided, the second coded information being obtained by encoding a second layer of the coding apparatus using the first coded information, the second coded information including second band information generated by selecting a second quantization target band of the second layer from the plurality of sub-bands; a first layer decoding step of inputting the first coded information obtained from the information thereto, and generating a first decoded signal with respect to the first quantization target band set based on the first band information; and a second layer decoding step of inputting the second coded information obtained from the information thereto, and generating a second decoded signal with respect to the second quantization target band set based on the second band information, wherein: the first layer decoding step includes a determining step of determining a method of decoding a gain of the first decoded signal from a plurality of candidates based on the first band information.

Advantageous Effects of Invention

According to the invention, in the hierarchy coding (scalable coding) scheme in which the band of the coding target is selected in each hierarchy (layer), coding efficiency of frequency parameters in a current frame is improved, and therefore the quality of the decoded signal can be improved.

DESCRIPTION OF EMBODIMENTS

Figure 1:
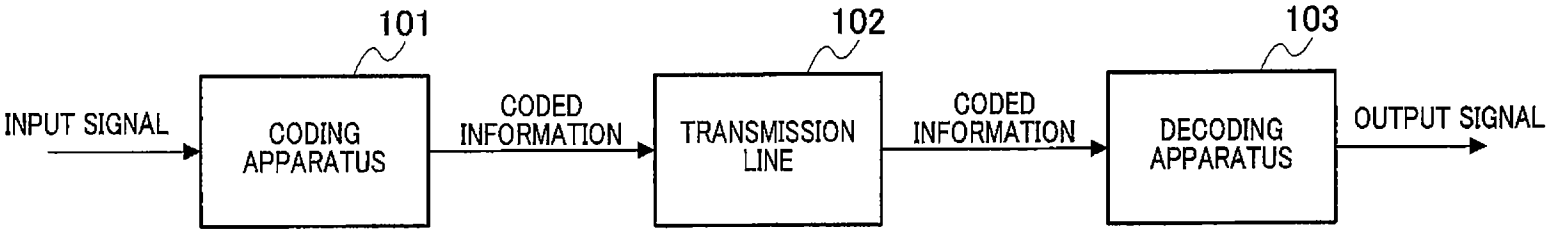
FIG. 1 is a block diagram illustrating a configuration of a communication system including a coding apparatus and a decoding apparatus according to Embodiment 1 of the invention.

Referring to the drawings, one embodiment of the present invention will be described in detail. A speech coding apparatus and a speech decoding apparatus are described as examples of the coding apparatus and decoding apparatus of the invention.

The present invention is a technology based on a hierarchical coding (scalable coding) scheme in which the band of a coding target is selected in each hierarchy (layer). To be more specific, this is a technology of adaptively switching between predictive coding and non-predictive coding in the time axis direction and layer axis (hierarchical) direction as a method of quantizing frequency parameters of the coding target band in the hierarchical coding (scalable coding) scheme. Non-Patent Literature 2 discloses a technology of adaptively switching between predictive coding and non-predictive coding as a method of quantizing frequency parameters of the coding target band in a non-hierarchical coding scheme. The following embodiments will disclose a technology of adaptively switching between predictive coding and non-predictive coding and realizing efficient predictive coding of frequency parameters as a method of quantizing frequency parameters of the coding target band in the hierarchical coding (scalable coding) scheme.

Embodiment 1

FIG. 1 is a block diagram illustrating a configuration of a communication system including a coding apparatus and a decoding apparatus according to Embodiment 1 of the invention. In FIG. 1, the communication system includes coding apparatus 101 and decoding apparatus 103, and coding apparatus 101 and decoding apparatus 103 can conduct communication with each other through transmission line 102. Herein, coding apparatus 101 and decoding apparatus 103 are usually mounted in a base station apparatus, a communication terminal apparatus, and the like for use.

Coding apparatus 101 divides an input signal into respective N samples (N is a natural number), and performs encoding in each frame with the N samples as one frame. Here, it is assumed that $x_n$ (n=0, . . . , N−1) is the input signal that becomes a coding target. n expresses an (n+1)th signal element in the input signal that is divided every N samples. Coding apparatus 101 transmits coded input information (hereinafter referred to as "coded information") to decoding apparatus 103 through transmission line 102.

Decoding apparatus 103 receives the coded information that is transmitted from coding apparatus 101 through transmission line 102, and decodes the coded information to obtain an output signal.

Figure 2:
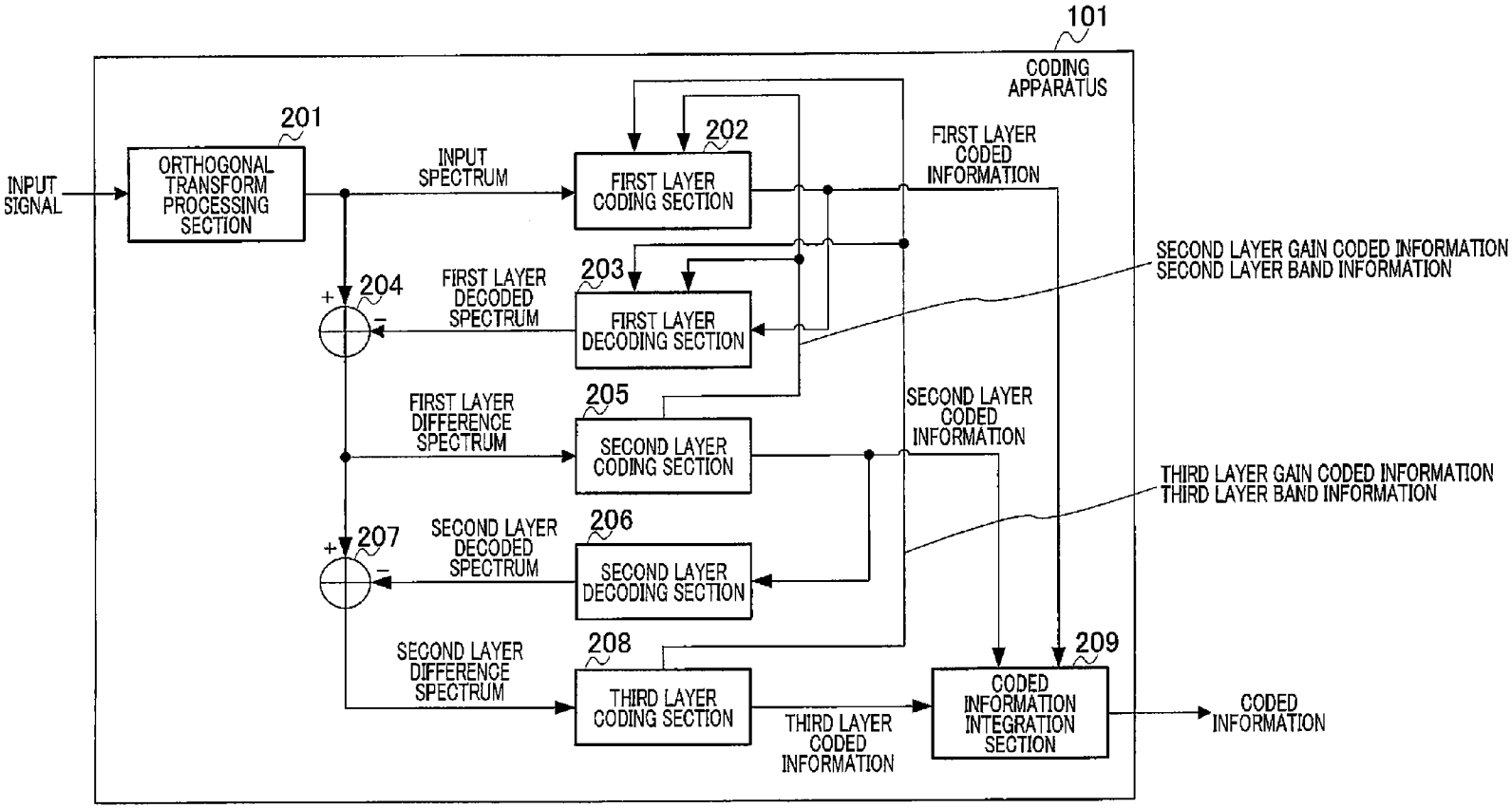
FIG. 2 is a block diagram illustrating a main internal configuration of the coding apparatus according to Embodiment 1.

FIG. 2 is a block diagram illustrating a main internal configuration of coding apparatus 101 shown in FIG. 1. For example, it is assumed that coding apparatus 101 is a hierarchical coding apparatus including three coding hierarchies (layers). Here, it is assumed that the three layers are referred to as a first layer, a second layer and a third layer in the ascending order of a bit rate.

Orthogonal transform processing section 201 incorporates buffer buf1(n) (n=0, . . . , N−1) and performs modified discrete cosine transform (MDCT) on input signal x1(n). Thus, input signal x1(n) is transformed into a frequency domain parameter (frequency domain signal).

Orthogonal transform processing in orthogonal transform processing section 201, namely, an orthogonal transform processing calculating procedure and data output to an internal buffer will be described below.

Orthogonal transform processing section 201 initializes buffer buf1(n) to an initial value "0" by following equation 1.

$$\mathrm{buf1}(n)=0(n=0,\ldots,N-1) \quad \text{(Equation 1)}$$

Next, orthogonal transform processing section 201 performs the modified discrete cosine transform (MDCT) on input signal x1(n) according to equation 2 below, and obtains an MDCT coefficient (hereinafter referred to as a "input spectrum") X1(k) of input signal x1(n).

(Equation 2)

$$X1(k)=\frac{2}{N}\sum_{n=0}^{2N-1}x1'(n)\cos\left[\frac{(2n+1+N)(2k+1)\pi}{4N}\right] \quad [2]$$

$$(k=0,\ldots,N-1)$$

Where k is an index of each sample in one frame. Using following equation 3 below, orthogonal transform processing section 201 obtains x1'(n) that is a vector formed by coupling input signal x1(n) and buffer buf1(n).

(Equation 3)

$$x1'(n)=\begin{cases} buf1(n) & (n=0,\ldots N-1) \\ x1(n-N) & (n=N,\ldots 2N-1) \end{cases} \quad [3]$$

Then, orthogonal transform processing section 201 updates buffer buf1(n) using following equation 4.

$$\mathrm{buf1}(n)=x1(n)(n=0,\ldots N-1) \quad \text{(Equation 4)}$$

Orthogonal transform processing section 201 outputs input spectrum X1(k) to first layer coding section 202 and adder 204.

Input spectrum X1(k) is inputted to first layer coding section 202 from orthogonal transform processing section 201. Furthermore, second layer gain coded information and second layer band information included in second layer coded information in the processing frame one frame before the current frame are inputted to first layer coding section 202 from second layer coding section 205. Furthermore, third layer gain coded information and third layer band information included in third layer coded information in the processing frame one frame before the current frame are inputted to first layer coding section 202 from third layer coding section 208.

First layer coding section 202 encodes input spectrum X1(k) using the inputted information to generate first layer coded information. Next, first layer coding section 202 outputs the generated first layer coded information to first layer decoding section 203 and coded information integration section 209. The details of first layer coding section 202 will be described later.

The first layer coded information is inputted to first layer decoding section 203 from first layer coding section 202. Furthermore, second layer gain coded information in the processing frame one frame before the current frame is inputted to first layer decoding section 203 from second layer coding section 205. Furthermore, third layer gain coded information in the processing frame one frame before the current frame is inputted to first layer decoding section 203 from third layer coding section 208.

First layer decoding section 203 decodes the first layer coded information using the band information and gain coded information to calculate a first layer decoded spectrum. Next, first layer decoding section 203 outputs the generated first layer decoded spectrum to adder 204. The details of first layer coding section 203 will be described later.

Adder 204 adds the first layer decoded spectrum to the input spectrum while inverting the polarity of the first layer decoded spectrum, thereby calculating a difference spectrum between the input spectrum and the first layer decoded spectrum. Adder 204 outputs the obtained difference spectrum as a first layer difference spectrum to second layer coding section 205.

Second layer coding section 205 generates second layer coded information using the first layer difference spectrum inputted from adder 204. Next, second layer coding section 205 outputs the generated second layer coded information to second layer decoding section 206 and coded information integration section 209. Furthermore, second layer coding section 205 outputs the second layer gain coded information and second layer band information included in the second layer coded information to first layer coding section 202. Thus, in the next processing frame, first layer coding section 202 performs encoding using the second layer gain coded information and second layer band information. The details of second layer coding section 205 will be described later.

Second layer decoding section 206 decodes the second layer coded information inputted from second layer coding section 205, and calculates a second layer decoded spectrum. Next, second layer decoding section 206 outputs the generated second layer decoded spectrum to adder 207. The details of second layer decoding section 206 will be described later.

Adder 207 adds the second layer decoded spectrum to the first layer difference spectrum while inverting the polarity of the second layer decoded spectrum, thereby calculating a difference spectrum between the first layer difference spectrum and the second layer decoded spectrum. Adder 207 outputs the obtained difference spectrum as a second layer difference spectrum to third layer coding section 208.

Third layer coding section 208 generates third layer coded information using the second layer difference spectrum inputted from adder 207 and outputs the generated third layer coded information to coded information integration section 209. Furthermore, third layer coding section 208 outputs the third layer gain coded information and third layer band information both included in the third layer coded information to first layer coding section 202 and first layer decoding section 203. Thus, in the next processing frame, first layer coding section 202 and first layer decoding section 203 perform encoding using the third layer gain coded information and third layer band information. The details of third layer coding section 208 will be described later.

Coded information integration section 209 integrates the first layer coded information inputted from first layer coding section 202, the second layer coded information inputted from second layer coding section 205 and the third layer coded information inputted from third layer coding section 208. Next, coded information integration section 209 adds a transmission error code or the like to the integrated information source code as required and outputs this as coded information to transmission line 102.

Figure 3:
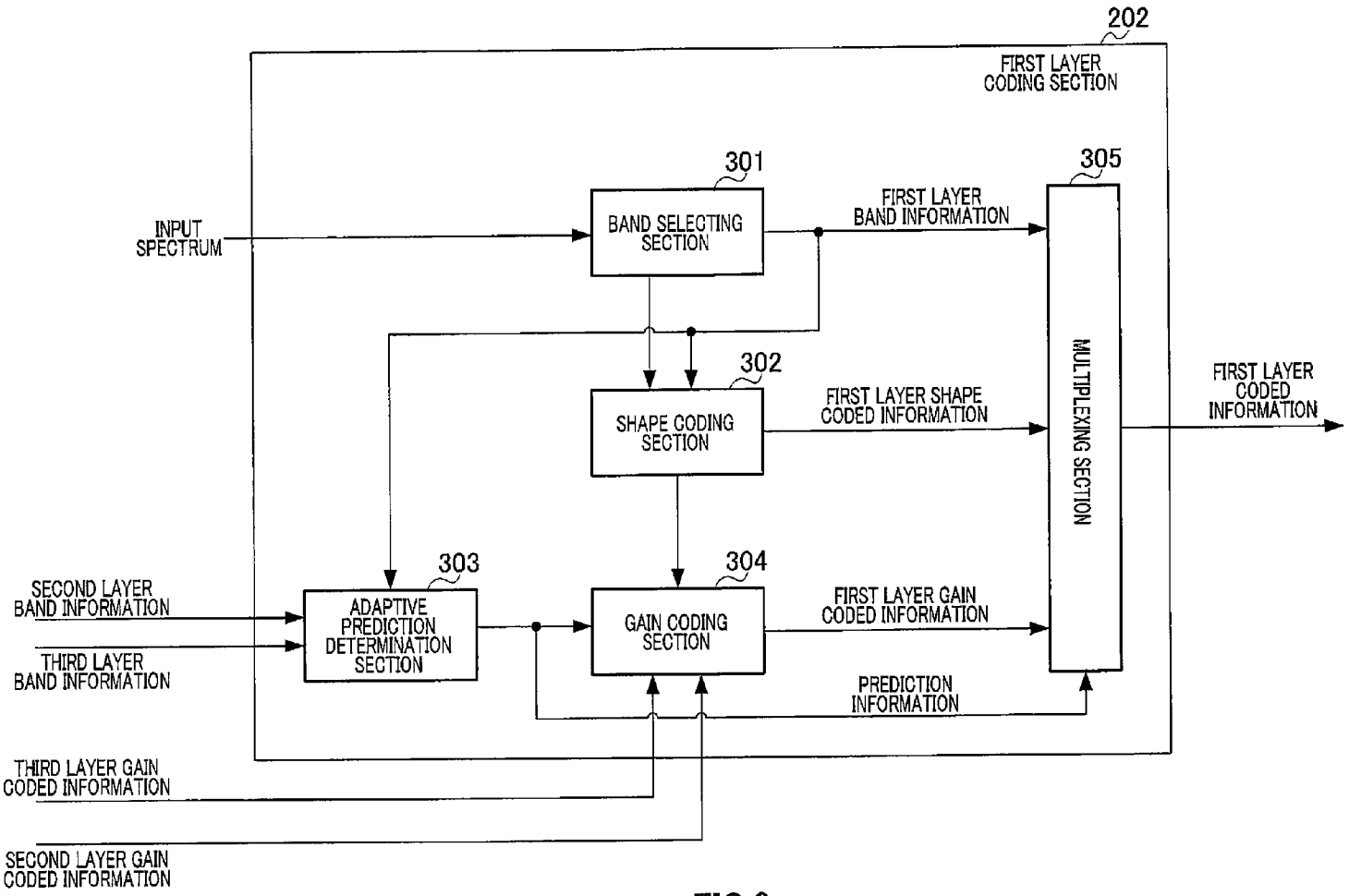
FIG. 3 is a block diagram illustrating a main internal configuration of the first layer coding section shown in FIG. 2.

FIG. 3 is a block diagram illustrating a main configuration of first layer coding section 202.

In FIG. 3, first layer coding section 202 includes band selecting section 301, shape coding section 302, adaptive prediction determination section 303, gain coding section 304, and multiplexing section 305.

Band selecting section 301 divides the input spectrum inputted from orthogonal transform processing section 201 into a plurality of sub-bands and selects a band (quantization target band) that becomes a quantization target from a plurality of sub-hands. Band selecting section 301 outputs the band information (first layer band information) indicating the selected quantization target band to shape coding section 302, adaptive prediction determination section 303, and multiplexing section 305. Furthermore, band selecting section 301 outputs the input spectrum to shape coding section 302. The input spectrum may be inputted to shape coding section 302 directly from orthogonal transform processing section 201 independently of the input from orthogonal transform processing section 201 to band selecting section 301. The details of processing of band selecting section 301 will be described later.

Using the spectrum (MDCT coefficient) corresponding to the band indicated by the first layer band information in the input spectrum inputted from band selecting section 301, shape coding section 302 encodes the shape information to generate first layer shape coded information. Next, shape coding section 302 outputs the generated first layer shape coded information to multiplexing section 305. Furthermore, shape coding section 302 outputs an ideal gain (gain information) calculated during shape encoding to gain coding section 304. The details of processing of shape coding section 302 will be described later.

First layer band information is inputted to adaptive prediction determination section 303 from band selecting section 301. Furthermore, second layer band information is inputted to adaptive prediction determination section 303 from second layer coding section 205. Furthermore, third layer band information is inputted to adaptive prediction determination section 303 from third layer coding section 208. Adaptive prediction determination section 303 includes an internal buffer that stores first layer band information, second layer band information, and third layer band information inputted in the past from band selecting section 301, second layer coding section 205, and third layer coding section 208 respectively.

Adaptive prediction determination section 303 obtains the number of sub-bands common between the quantization target band of the current frame and the quantization target band of the past frame using the band information inputted (first layer band information, second layer band information, third layer band information). When the number of common sub-bands is equal to or more than a predetermined value, adaptive prediction determination section 303 determines that predictive coding is performed on the spectrum (MDCT coefficient) of the quantization target band indicated by the first layer band information. On the other hand, when the number of common sub-bands is less than the predetermined value, adaptive prediction determination section 303 determines that predictive coding is not performed on the spectrum (MDCT coefficient) of the quantization target band indicated by the first layer band information.

Adaptive prediction determination section 303 outputs the determination result as prediction information (Flag_PRE) to gain coding section 304 and multiplexing section 305. Here, adaptive prediction determination section 303 sets the value of Flag_PRE to 1 when determining that prediction is performed, and sets the value of Flag_PRE to 0 when determining that prediction is not performed. The details of processing of adaptive prediction determination section 303 will be described later.

The ideal gain is inputted to gain coding section 304 from shape coding section 302. Furthermore, the prediction information is inputted to gain coding section 304 from adaptive prediction determination section 303. Furthermore, the second layer gain coded information and third layer gain coded information in the processing frame one frame before the current frame are inputted to gain coding section 304 from second layer coding section 205 and third layer coding section 208.

When the prediction information indicates a determination result that predictive coding is performed, gain coding section 304 performs predictive coding on the ideal gain inputted from shape coding section 302 and obtains first layer gain coded information. At this, time, gain coding section 304 performs predictive coding on the ideal gain using the quantization gain of the past frame stored in the built-in buffer, built-in gain codebook, second layer gain coded information, and third layer gain coded information.

On the other hand, when the prediction information indicates a determination result that predictive coding is not performed, gain coding section 304 quantizes the ideal gain inputted from shape coding section 302 as is (that is, quantizes the ideal gain without applying prediction thereto).

Gain coding section 304 outputs first layer gain coded information obtained by encoding the ideal gain to multiplexing section 305. The details of processing of gain coding section 304 will be described later.

Multiplexing section 305 multiplexes the first layer band information, first layer shape coded information, first layer gain coded information, and prediction information to generate first layer coded information. Multiplexing section 305 outputs the generated first layer coded information to first layer decoding section 203 and coded information integration section 209.

First layer coding section 202 having the above configuration is operated as follows.

Input spectrum X1(k) is inputted to band selecting section 301 from orthogonal transform processing section 201.

Band selecting section 301 divides input spectrum X1(k) into a plurality of sub-bands first. The case that the first layer difference spectrum X1(k) is equally divided into J (J is a natural number) sub-bands will be described by way of example. Band selecting section 301 then selects consecutive L (L is a natural number) sub-bands in the J sub-bands to obtain M (M is a natural number) kinds of groups of the sub-bands. Hereinafter, the M kinds of groups of the sub-bands are referred to as a region.

Figure 4:
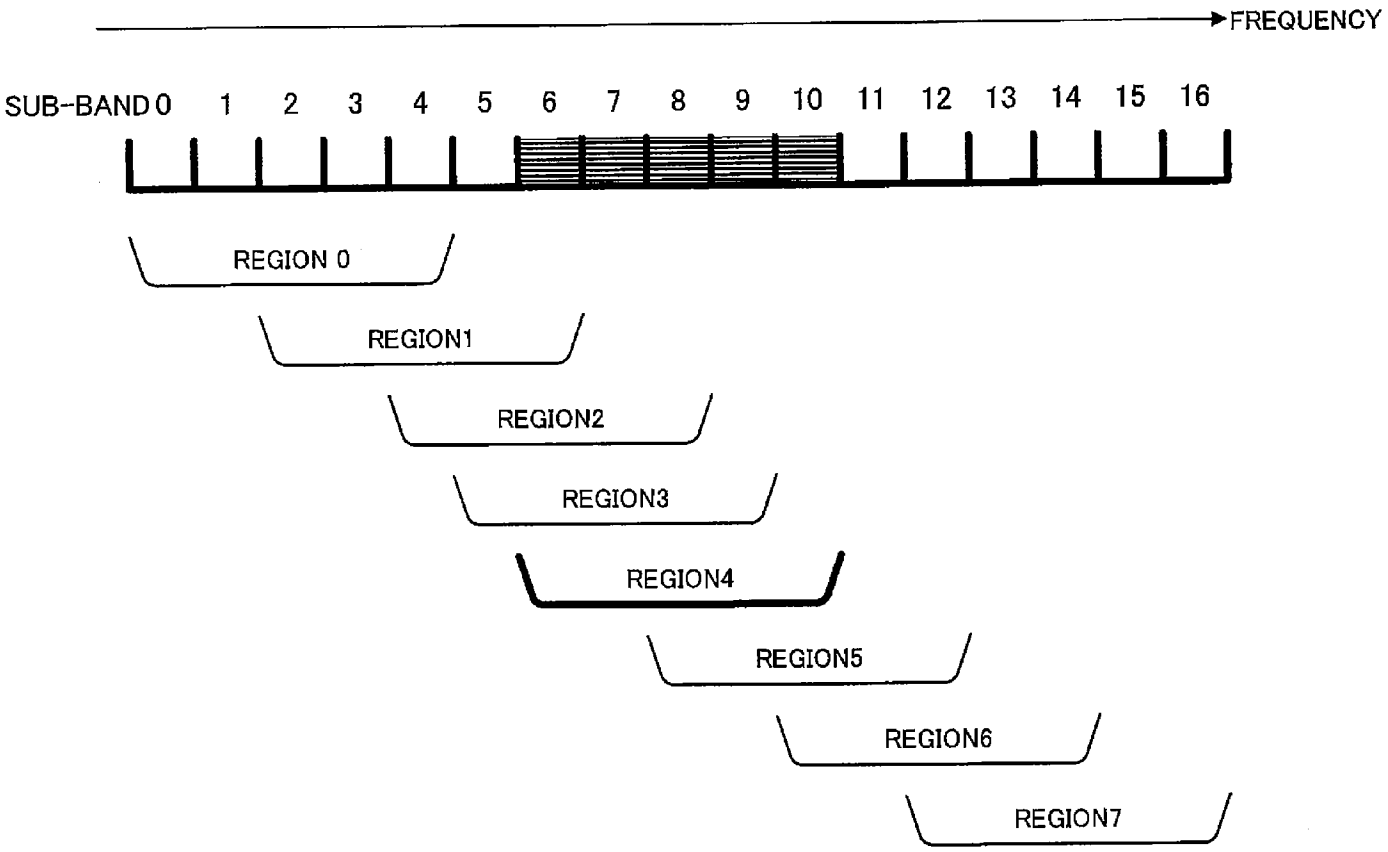
FIG. 4 is a diagram illustrating a region according to Embodiment 1.

FIG. 4 is a view illustrating a configuration of a region obtained in band selecting section 301.

In FIG. 4, the number of sub-bands is 17 (J=17), the number of kinds of the regions is 8 (M=8), and consecutive 5 (L=5) sub-bands constitute each region. For example, region 4 includes sub-bands 6 to 10.

Then, band selecting section 301 calculates average energy E1(m) in each of the M kinds of regions according to following equation 5.

(Equation 5)

$$E1(m) = \frac{\sum_{j=S(m)}^{S(m)+L-1} \sum_{k=B(j)}^{B(j)+W(j)} (X1(k))^2}{L} \quad (m = 0, \ldots, M-1) \qquad [5]$$

Where j is an index of each of the J sub-bands and m is an index of each of the M kinds of regions. S(m) indicates a minimum value in indexes of the L sub-bands constituting region m, and B(j) is a minimum value in indexes of the plural MDCT coefficients constituting sub-band j. W(j) indicates a band width of sub-band j. The case that J sub-bands have the equal band width, namely, W(j) is a constant, will be described below by way of example.

Next, band selecting section 301 selects a region where average energy E1(m) is maximized, for example, a band including to sub-band j" to (j"+L−1) as the band of the quantization target (quantization target band). Band selecting section 301 outputs index m_max indicating the selected region as first layer band information to shape coding section 302, adaptive prediction determination section 303, and multiplexing section 305. Furthermore, band selecting section 301 outputs input spectrum X1(k) of the quantization target band to shape coding section 302. Hereinafter, it is assumed that j" to (j"+L−1) are band indexes indicating the quantization target band selected by band selecting section 301.

Shape coding section 302 performs shape quantization on input spectrum X1(k) corresponding to the band that is indicated by first layer band information in each sub-band. To be more specific, shape coding section 302 searches a built-in shape codebook including SQ shape code vectors in each of the L sub-bands, and obtains the index of the shape code vector in which evaluation scale Shape_q(i) of following equation 6 is maximized.

(Equation 6)

$$\text{Shape_q}(i) = \frac{\left\{\sum_{k=0}^{W(j)} (X1(k+B(j)) \cdot SC_k^i)\right\}^2}{\sum_{k=0}^{W(j)} SC_k^i \cdot SC_k^i} \quad (j = j'', \ldots, j''+L-1,\ i = 0, \ldots, SQ-1) \qquad [6]$$

Where $SC^i_k$ is the shape code vector constituting the shape codebook, i is the index of the shape code vector, and k is the index of the element of the shape code vector.

Shape coding section 302 outputs index S_max of the shape code vector, in which evaluation scale Shape_q(i) of equation 6 is maximized, as the first layer shape coded information to multiplexing section 305. Furthermore, shape coding section 302 calculates ideal gain Gain_i(j) according to following equation 7, and outputs calculated ideal gain Gain_i(j) to gain coding section 304.

(Equation 7)

$$\text{Gain_i}(j) = \frac{\sum_{k=0}^{W(j)} (X1(k+B(j)) \cdot SC_k^{S_max})}{\sum_{k=0}^{W(j)} SC_k^{S_max} \cdot SC_k^{S_max}} \quad (j = j'', \ldots, j''+L-1) \qquad [7]$$

Adaptive prediction determination section 303 includes a built-in buffer that stores the first layer band information in the past frame. A case will be described below where adaptive prediction determination section 303 incorporates the buffer that stores the pieces of band information for the past one frame.

The second layer band information in the processing frame one frame before the current frame is inputted to adaptive prediction determination section 303 from second layer coding section 205. Furthermore, the third layer band information in the processing frame one frame before the current frame is inputted to adaptive prediction determination section 303 from third layer coding section 208.

First of all, adaptive prediction determination section 303 obtains the number of sub-bands common between the quantization target band of the past frame and the quantization target band of the current frame using the first layer band information, second layer band information, third layer band information in the past frame and the first layer band information in the current frame.

Next, adaptive prediction determination section 303 determines that the predictive coding is performed when the number of common sub-bands is equal to or more than a predetermined value, and adaptive prediction determination section 303 determines that the predictive coding is not performed when the number of common sub-bands is less than the predetermined value. To be more specific, adaptive prediction determination section 303 compares the sub-band group (assumed to be set $M123_{t-1}$) of the union of the sub-band (assumed to be set $M1_{t-1}$) indicated by the first layer band information, the sub-band (assumed to be set $M2_{t-1}$) indicated by the second layer band information and the sub-band (assumed to be set $M3_{t-1}$) indicated by the third layer band information in the processing frame one frame before the current frame with the L sub-bands (assumed to be set $M1_t$) indicated by the first layer band information in the current frame.

Here, set $M123_{t-1}$ can be expressed by equation 8 below using set $M1_{t-1}$, set $M2_{t-1}$, and set $M3_{t-1}$.

$$M123_{t-1}=M1_{t-1}\cup M2_{t-1}\cup M3_{t-1} \quad \text{(Equation 8)}$$

Adaptive prediction determination section 303 determines that the predictive coding is performed when the number of common sub-bands is equal to or more than P, and sets Flag_PRE=1. On the other hand, adaptive prediction determination section 303 determines that the predictive coding is not performed when the number of common sub-bands is less than P, and sets Flag_PRE=0.

By this means, adaptive prediction determination section 303 sets the value of prediction information Flag_PRE as described above, based on the number of common sub-bands among sub-bands included in $M1_t$ and $M123_{t-1}$. This causes the quantization method to be adaptively switched to one of the predictive coding method and non-predictive coding method.

Next, adaptive prediction determination section 303 outputs prediction information (Flag_PRE) as information indicating the determination result to gain coding section 304 and multiplexing section 305. Next, adaptive prediction determination section 303 updates the built-in buffer using the first layer band information, second layer band information, and third layer band information in the current frame.

Gain coding section 304 includes an internal buffer that stores quantization gains obtained in past frames.

An ideal gain is inputted to gain coding section 304 from shape coding section 302. Furthermore, prediction information (Flag_PRE) is inputted to gain coding section 304 from adaptive prediction determination section 303. Furthermore, second layer gain coded information and third layer gain coded information are inputted to gain coding section 304 from second layer coding section 205 and third layer coding section 208 respectively.

Gain coding section 304 adaptively switches the quantization method to one of the predictive coding method and non-predictive coding method according to the prediction information (Flag_PRE).

[When Flag_PRE=1]

In this case, gain coding section 304 performs predictive coding. That is, gain coding section 304 predicts the gain of the current frame using the quantization gain quantized in processing frames up to the frame three frames before the current frame that are stored in the built-in buffer, the second layer gain coded information, and the third layer gain coded information to generate the quantization gain of the current frame. Specifically, gain coding section 304 searches the built-in gain codebook including the GQ gain code vectors in each of the L sub-bands, and obtains the index of the gain code vector in which square error Gain_q(i) of following equation 9 is minimized.

(Equation 9)

$$\text{Gain_q}(i) = \left\{\sum_{j=0}^{L-1}\left\{\begin{array}{c}\text{Gain_i}(j+j'') - \sum_{t=1}^{3}\left(\alpha_t\cdot\left(C1^t_{j+j''} + C2^t_{j+j''} + C3^t_{j+j''}\right)\right) - \\ \alpha_0\cdot GC1^i_j\end{array}\right\}\right\}^2 \quad [9]$$

$$(i = 0, \ldots, GQ-1)$$

Where $GC1^i_j$ is the gain code vector constituting the gain codebook in first layer coding section 202, i is the index of the gain code vector, and j is the index of the element of the gain code vector. For example, j has values of 0 to 4 in the case that the number of sub-bands constituting the region is 5 (in the case of L=5). Furthermore, sub-band index j" is the index indicating the first sub-band of the band selected in band selecting section 301. At this point, $C1^t_j$ indicates the gain quantized in first layer coding section 202 t frames before the current frame. For example, in the case of t=1, $C1^1_j$ indicates the gain quantized in first layer coding section 202 one frame before the current frame. Similarly, $C2^t_j$ and $C3^t_j$ indicate the gains quantized in second layer coding section 205 and third layer coding section 208 respectively t frames before the current frame. Furthermore, $\alpha 0$ to $\alpha 3$ are quartic linear prediction coefficients stored in gain coding section 304. Gain coding section 304 deals with the L sub-bands in one region as an L-dimensional vector to perform vector quantization.

In the case that the gain of the quantization target band in the past frame is not present in the built-in buffer, in equation 9, gain coding section 304 substitutes the gain of the sub-band closest to the quantization target band in the current frame in terms of the frequency among gains stored in the built-in buffer.

[When Flag_PRE=0]

In this case, gain coding section 304 performs non-predictive coding. To be more specific, gain coding section 304 directly quantizes ideal gain Gain_i(j) inputted from shape coding section 302 according to equation 10 below. Gain coding section 304 deals with the ideal gain as the L-dimensional vector to perform the vector quantization.

(Equation 10)

$$\text{Gain_q}(i) = \left\{\sum_{j=0}^{L-1}\{\text{Gain_i}(j+j'') - GC1^i_j\}\right\}^2 \quad [10]$$

$$(i = 0, \ldots, GQ-1)$$

Gain coding section 304 outputs index G_min of the gain code vector, in which square error Gain_q(i) in equation 9 or equation 10 above is minimized, as the first layer gain coded information to multiplexing section 305.

Furthermore, gain coding section 304 updates the built-in buffer according to equation 11 below using first layer gain coded information G_min, first layer band information, and quantization gains $C1^t_j$, $C2^t_j$, $C3^t_j$, which are obtained in the current frame.

(Equation 11)

$$\{C1^1_{j+j''} = GC1_j^{G_min} \quad (j = 0, \ldots, L-1) \qquad [11]$$

$$\begin{cases} C1^3_j = C1^2_j \\ C1^2_j = C1^1_j \\ C2^3_j = C2^2_j \\ C2^2_j = C2^1_j \\ C3^3_j = C3^2_j \\ C3^2_j = C3^1_j \end{cases} \quad (j = 0, \ldots, J-1)$$

Multiplexing section 305 multiplexes the first layer band information, first layer shape coded information, first layer gain coded information, and prediction information to generate first layer coded information. Next, multiplexing section 305 outputs the generated first layer coded information to first layer decoding section 203 and coded information integration section 209.

Figure 5:
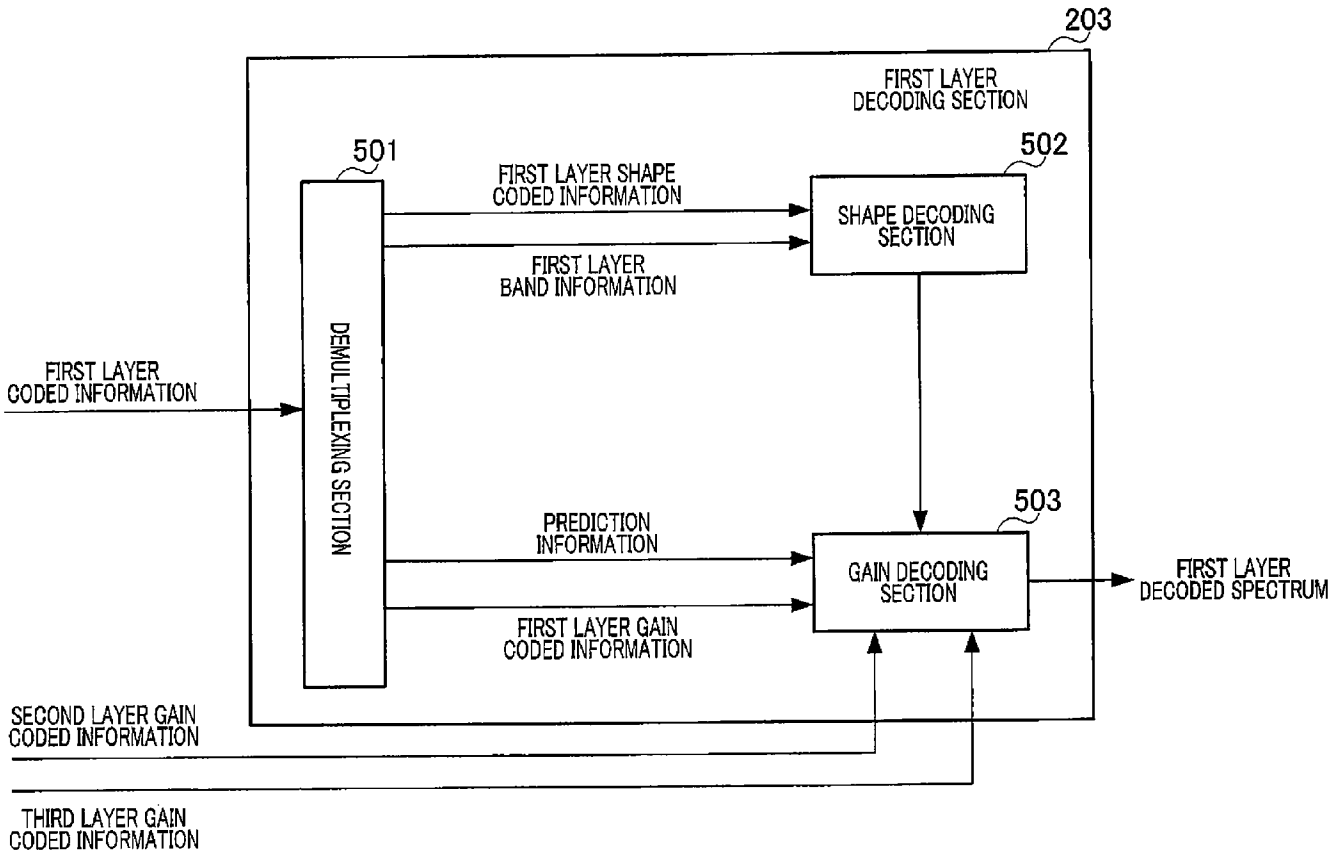
FIG. 5 is a block diagram illustrating a main internal configuration of the first layer decoding section shown in FIG. 2.

FIG. 5 is a block diagram illustrating a main configuration of first layer decoding section 203.

In FIG. 5, first layer decoding section 203 includes demultiplexing section 501, shape decoding section 502, and gain decoding section 503.

Demultiplexing section 501 demultiplexes the first layer coded information outputted from first layer coding section 202 into first layer band information, first layer shape coded information, first layer gain coded information, and prediction information. Demultiplexing section 501 outputs the obtained first layer band information and first layer shape coded information to shape decoding section 502 and outputs the first layer gain coded information and prediction information to gain decoding section 503.

Shape decoding section 502 decodes the first layer shape coded information inputted from demultiplexing section 501 and thereby obtains the value of the shape of the MDCT coefficient corresponding to the quantization target band indicated by the first layer band information inputted from demultiplexing section 501. Shape decoding section 502 outputs the value of the shape of the obtained MDCT coefficient to gain decoding section 503. The details of processing of shape decoding section 502 will be described later.

The second layer gain coded information in the processing frame one frame before the current frame is inputted to gain decoding section 503 from second layer coding section 205. Furthermore, the third layer gain coded information in the processing frame one frame before the current frame is inputted to gain decoding section 503 from third layer coding section 208. Furthermore, the first layer gain coded information and prediction information are inputted to gain decoding section 503 from demultiplexing section 501. Furthermore, the value of the shape of the MDCT coefficient is inputted to gain decoding section 503 from shape decoding section 502.

When the prediction information indicates that predictive decoding is performed (that is, when Flag_PRE=1), gain decoding section 503 performs predictive decoding on the first layer gain coded information inputted from demultiplexing section 501 to obtain the gain. Here, gain decoding section 503 performs predictive decoding on the first layer gain coded information using the second layer gain coded information, third layer gain coded information, the gain of the past frame stored in the built-in buffer, and the built-in gain codebook.

On the other hand, when the prediction information indicates that the predictive decoding is not performed (that is, when Flag_PRE=0), gain decoding section 503 dequantizes the first layer gain coded information as is (that is, without performing predictive decoding) using the built-in gain codebook to obtain the gain.

Gain decoding section 503 calculates the MDCT coefficient of the quantization target band using the obtained gain and the value of the shape inputted from shape decoding section 502, and outputs the obtained MDCT coefficient as the first layer decoded spectrum to adder 204. The details of processing of gain decoding section 503 will be described later.

First layer decoding section 203 having the above configuration is operated as follows.

Demultiplexing section 501 demultiplexes the first layer coded information into the first layer band information, first layer shape coded information, first layer gain coded information, and prediction information. Next, demultiplexing section 501 outputs the obtained first layer band information, and first layer shape coded information to shape decoding section 502 and outputs the first layer gain coded information, and prediction information to gain decoding section 503.

Shape decoding section 502 incorporates a shape codebook similar to the shape codebook provided for shape coding section 302 of first layer coding section 202, and searches the shape code vector in which first layer shape coded information S_max inputted from demultiplexing section 501 is used as the index. Shape decoding section 502 outputs to gain decoding section 503, the searched shape code vector as the value of the shape of the MDCT coefficient of the quantization target band indicated by the first layer band information inputted from demultiplexing section 501. At this point, the shape code vector that is searched as the value of the shape is expressed by Shape_q(k) (k=B(j"), . . . , B(j"+L)−1).

Gain decoding section 503 includes a built-in buffer that stores gains obtained in past frames.

Gain decoding section 503 adaptively switches the dequantization method to one of a predictive decoding method and non-predictive decoding method according to the prediction information (Flag_PRE).

[When Flag_PRE=1]

In this case, gain decoding section 503 performs predictive decoding. That is, gain decoding section 503 predicts the gain of the current frame using gains in past frames stored in the built-in buffer to thereby perform dequantization. To be more specific, gain decoding section 503 incorporates a gain codebook similar to that of gain coding section 304 of first layer coding section 202, and dequantizes the gain according to equation 12 below to obtain gain Gain_q'.

(Equation 12)

$$\text{Gain_q}'(j + j'') = \sum_{t=1}^{3} \left(\alpha_t \cdot \left(C1''^t_{j+j''} + C2''^t_{j+j''} + C3''^t_{j+j''}\right)\right) + \alpha_0 \cdot GC1_j^{G_min} \quad (j = 0, \ldots, L-1) \qquad [12]$$

Where $C1''^t_j$ is a gain value dequantized in first layer decoding section 203 t frames before the current frame. For example, in the case of t=1, $C1''^1_j$ is the gain dequantized in first layer decoding section 203 one frame before the current frame. Similarly, $C2''^t_j$ and $C3''^t_j$ are gains dequantized in second layer decoding section 206 and third layer coding section 208 t frames before the current frame respectively. Furthermore, sub-band index j" is the index indicating the first sub-band of the band indicated by the first layer band information. Furthermore, $\alpha_0$ to $\alpha_3$ are quartic linear prediction coefficients stored in gain decoding section 503. Gain decoding section 503 deals with the L sub-bands in one region as the L-dimensional vector to perform vector dequantization.

In the case that the gain in the decoding target band in the past frame is not present in the built-in buffer, gain decoding section 503 substitutes the gain of the sub-band closest to the decoding target band in the current frame in terms of the frequency among gains stored in the built-in buffer according to equation 12 above.

[When Flag_PRE=0]

In this case, gain decoding section 503 performs non-predictive decoding. That is, gain decoding section 503 dequantizes the gain according to equation 13 below using the gain codebook above. Here, gain decoding section 503 also deals with the gain as the L-dimensional vector to perform vector dequantization. That is, in the case that the predictive decoding is not performed, gain decoding section 503 directly uses gain code vector $GC1_i^{G_min}$ corresponding to first layer gain coded information G_min as the gain.

$$Gain_q'(j+j'')=GC1_j^{G_min}(j=0,\ldots,L-1) \quad \text{(Equation 13)}$$

Next, gain decoding section 503 calculates a first layer decoded spectrum (decoded MDCT coefficient) X1"(k) according to equation 14 below using the gain obtained by the dequantization of the current frame and the value of the shape inputted from shape decoding section 502. In the case that k exists in B(j") to B(j"+1)−1 during the dequantization of the MDCT coefficient, the gain has a value of Gain_q'(j").

(Equation 14)

$$X1''(k) = \text{Gain_q}'(j)\cdot\text{Shape_q}'(k) \quad [14]$$
$$\begin{pmatrix} k = B(j''),\ \ldots\ ,\ B(j''+L)-1 \\ j = j'',\ \ldots\ ,\ j''+L-1 \end{pmatrix}$$

Next, gain decoding section 503 updates the built-in buffer according to equation 15 below.

(Equation 15)

$$\{C1^{n1}_{j+j''} = GC_j^{G_min} \quad [15]$$
$$(j=0,\ \ldots\ ,L-1)$$

$$\begin{cases} C1^{n3}_j = C1^{n2}_j \\ C1^{n2}_j = C1^{n1}_j \\ C2^{n3}_j = C2^{n2}_j \\ C2^{n2}_j = C3^{n1}_j \\ C3^{n3}_j = C3^{n2}_j \\ C3^{n2}_j = C3^{n1}_j \end{cases}$$

$$(j=0,\ \ldots\ ,J-1)$$

Gain decoding section 503 outputs first layer decoded spectrum X1"(k) calculated according to equation 14 to adder 204 above.

Figure 6:
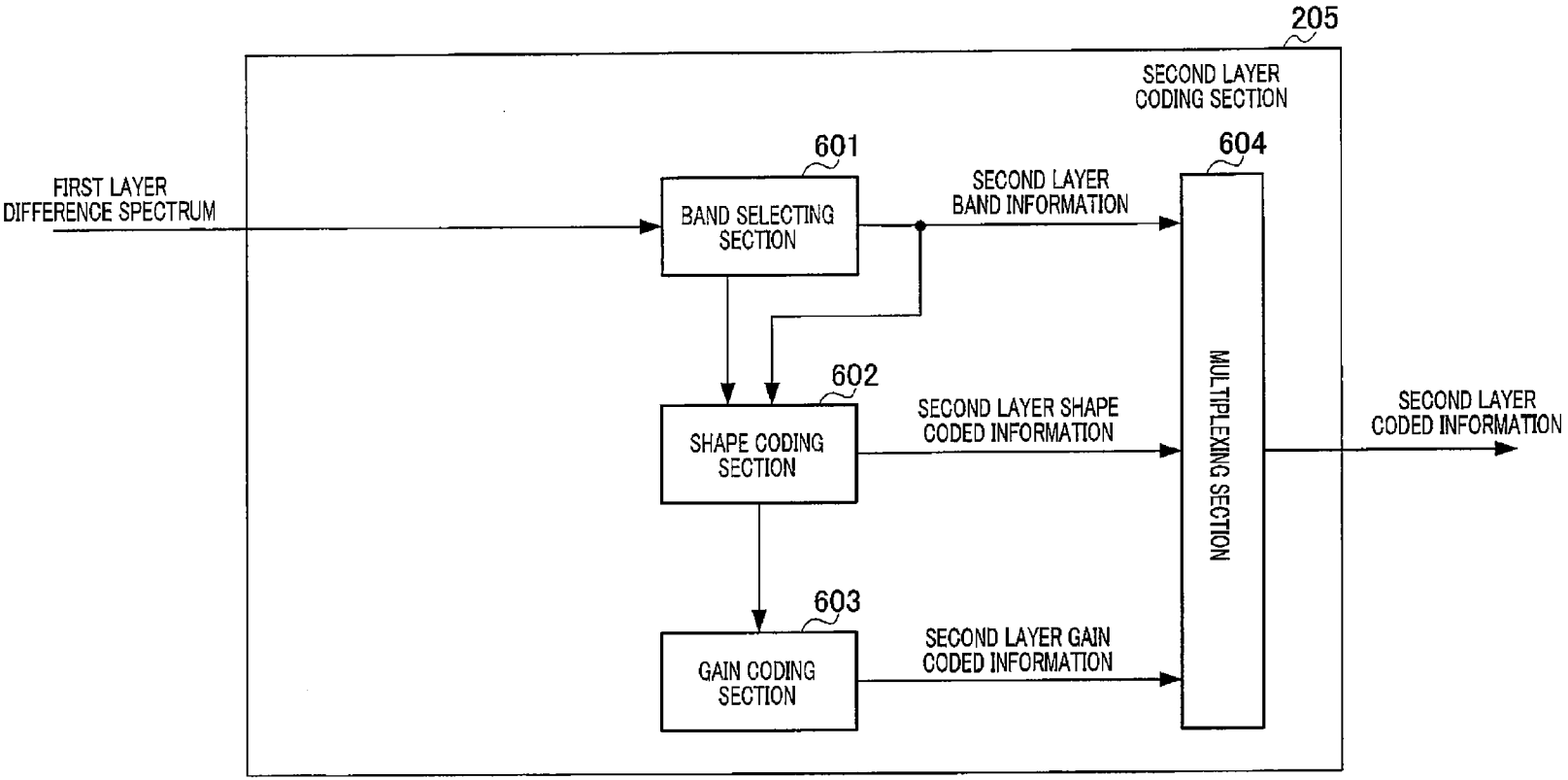
FIG. 6 is a block diagram illustrating a main internal configuration of the second layer coding section shown in FIG. 2.

FIG. 6 is a block diagram illustrating a main configuration of second layer decoding section 205.

In FIG. 6, second layer coding section 205 is provided with band selecting section 601, shape coding section 602, gain coding section 603, and multiplexing section 604.

Band selecting section 601 divides the first layer difference spectrum inputted from adder 204 into a plurality of sub-bands and selects a band (quantization target band) which is the quantization target from the plurality of sub-bands. Band selecting section 601 outputs the band information (second layer band information) indicating the selected quantization target band to shape coding section 602 and multiplexing section 604. The first layer difference spectrum may be inputted to shape coding section 602 directly from adder 204 independently of the input from adder 204 to band selecting section 601. The details of processing of band selecting section 601 are similar to those of aforementioned band selecting section 301, and therefore descriptions thereof will be omitted.

Shape coding section 602 encodes the shape information using the spectrum (MDCT coefficient) corresponding to the band indicated by the second layer band information in the first layer difference spectrum to generate second layer shape coded information. Next, shape coding section 602 outputs the generated second layer shape coded information to multiplexing section 604. Furthermore, shape coding section 602 outputs the ideal gain (gain information) calculated during shape coding to gain coding section 603. The details of processing of shape coding section 602 are similar to those of aforementioned shape coding section 302, and therefore descriptions thereof will be omitted.

The ideal gain is inputted to gain coding section 603 from shape coding section 602. Gain coding section 603 quantizes the ideal gain inputted from shape coding section 602 as is (that is, quantizing the ideal gain without applying prediction thereto) to obtain second layer gain coded information. Gain coding section 603 outputs the obtained second layer gain coded information to multiplexing section 604. The details of processing of gain coding section 603 are similar to those of the processing in the case that the prediction information indicates a determination result that the predictive coding is not performed (Flag_PRE=0) in above-described gain coding section 304, and therefore descriptions will be omitted here. However, gain coding section 603 performs processing by substituting $GC2^i_j$ for $GC1^i_j$ used in the processing of gain coding section 304. Here, $GC2^i_j$ is a gain code vector constituting the gain codebook used by gain coding section 603.

Multiplexing section 604 multiplexes the second layer band information, second layer shape coded information, and second layer gain coded information to generate second layer coded information. Multiplexing section 604 outputs the second layer coded information to second layer decoding section 206 and coded information integration section 209.

The processing of second layer coding section 205 has been described above.

Figure 7:
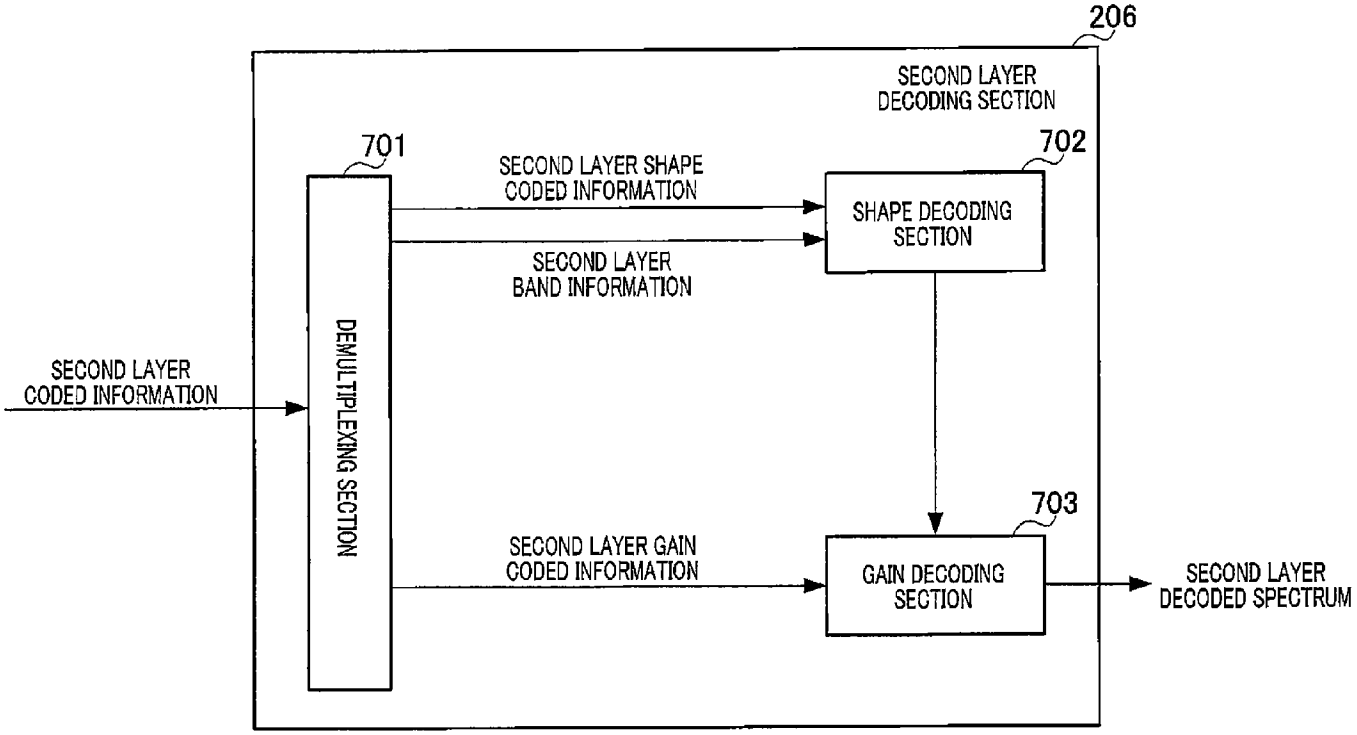
FIG. 7 is a block diagram illustrating a main internal configuration of the second layer decoding section shown in FIG. 2.

FIG. 7 is a block diagram illustrating a main configuration of second layer coding section 206.

In FIG. 7, second layer decoding section 206 is provided with demultiplexing section 701, shape decoding section 702, and gain decoding section 703.

Demultiplexing section 701 demultiplexes the second layer coded information outputted from second layer coding section 205 into second layer band information, second layer shape coded information, and second layer gain coded information. Demultiplexing section 701 outputs the obtained second layer band information and second layer shape coded information to shape decoding section 702, and outputs the second layer gain coded information to gain decoding section 703.

Shape decoding section 702 decodes the second layer shape coded information inputted from demultiplexing section 701 to thereby obtain the value of the shape of the decoded MDCT coefficient corresponding to the quantization target band indicated by the second layer band information inputted from demultiplexing section 701. Shape decoding section 702 outputs the obtained value of the shape of the decoded MDCT coefficient to gain decoding section 703. The details of processing of shape decoding section 702 are similar to those of aforementioned shape decoding section 502, and therefore descriptions thereof will be omitted here.

Gain decoding section 703 dequantizes the second layer gain coded information inputted from demultiplexing section 701 as is (that is, performing dequantization without predictive decoding) to obtain the gain. Gain decoding section 703 obtains the decoded MDCT coefficient of the quantization target band using the obtained gain and the value of the shape of the decoded MDCT coefficient inputted from shape decoding section 702. Gain decoding section 703 outputs the obtained decoded MDCT coefficient as the second layer decoded spectrum to adder 207. The details of processing of gain decoding section 703 are similar to those of the processing in the case that the prediction information in aforementioned gain decoding section 503 indicates a determination result that predictive coding is not performed (Flag_PRE=0), and therefore descriptions thereof will be omitted here. However, gain decoding section 703 performs processing by substituting $GC2^i_j$ for $GC1^i_j$ used in the processing of gain decoding section 503. Here, $GC2^i_j$ is a gain code vector constituting the gain codebook used in gain decoding section 703.

The processing of second layer decoding section 206 has been described above.

The internal configuration and processing of third layer coding section 208 are identical to the internal configuration and processing of second layer coding section 205 except that the terms of inputted/outputted signals are different, and therefore descriptions thereof will be omitted here. However, third layer coding section 208 performs processing by substituting $GC3^i_j$ for $GC2^i_j$ used in the processing of second layer coding section 205. Here, $GC3^i_j$ is a gain code vector constituting the gain codebook used in third layer coding section 208.

The processing of coding apparatus 101 has been described above.

Figure 8:
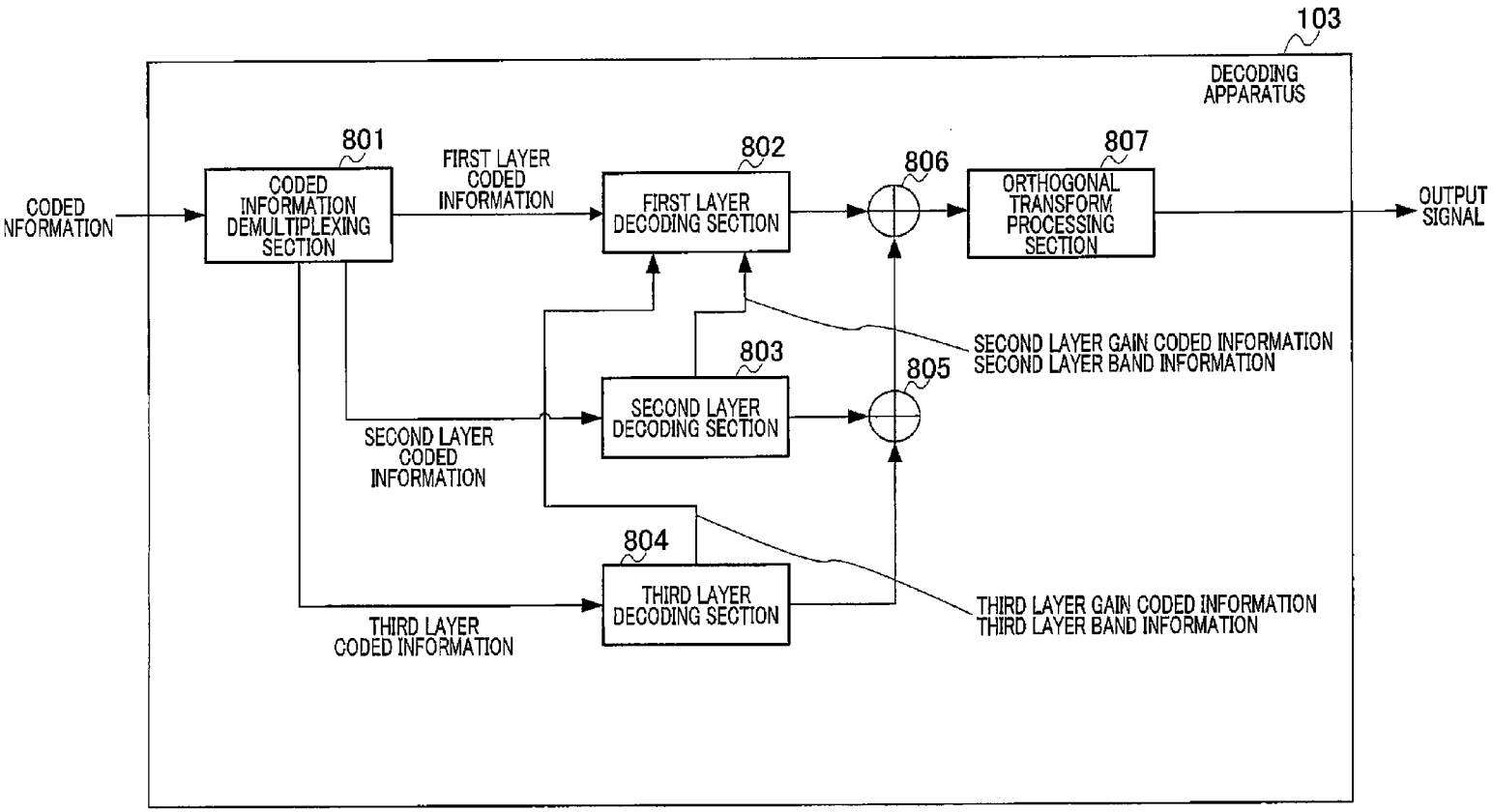
FIG. 8 is a block diagram illustrating a main internal configuration of a decoding apparatus according to Embodiment 1.

FIG. 8 is a block diagram illustrating a main configuration of decoding apparatus 103 in FIG. 1. For example, it is assumed that decoding apparatus 103 is a hierarchical decoding apparatus including three decoding hierarchies (layers). At this point, similarly to coding apparatus 101, it is assumed that the three layers are called a first layer, a second layer and a third layer in the ascending order of the bit rate.

The coded information transmitted from coding apparatus 101 through transmission line 102 is inputted to coded information demultiplexing section 801, and coded information demultiplexing section 801 demultiplexes the coded information into the pieces of coded information of the layers to output each piece of coded information to the decoding section that performs the decoding processing of each piece of coded information. Specifically, coded information demultiplexing section 801 outputs the first layer coded information included in the coded information to first layer decoding section 802. Furthermore, coded information demultiplexing section 801 outputs the second layer coded information included in the coded information to second layer decoding section 803. Coded information demultiplexing section 801 outputs the third layer coded information included in the coded information to third layer decoding section 804.

First layer decoding section 802 decodes the first layer coded information inputted from coded information demultiplexing section 801 to generate first layer decoded spectrum X1"(k), and outputs generated first layer decoded spectrum X1"(k) to adder 806. Since the processing of first layer decoding section 802 is identical to that of first layer decoding section 203, the description is omitted.

Second layer decoding section 803 decodes the second layer coded information inputted from coded information demultiplexing section 801 to generate second layer decoded spectrum X2"(k) and outputs generated second layer decoded spectrum X2"(k) to adder 805. Furthermore, second layer decoding section 803 outputs the second layer gain coded information and second layer band information included in the second layer coded information to first layer decoding section 802. Since the processing of second layer decoding section 803 is identical to that of second layer decoding section 206, the description is omitted.

Third layer decoding section 804 decodes the third layer coded information inputted from coded information demultiplexing section 801 to generate third layer decoded spectrum X3"(k) and outputs generated third layer decoded spectrum X3"(k) to adder 805. Furthermore, third layer decoding section 804 outputs the third layer gain coded information and third layer band information included in the third layer coded information to first layer decoding section 802. Since the processing of third layer decoding section 804 is identical to that of second layer decoding section 206, the description is omitted. However, third layer decoding section 804 performs processing by substituting $GC3^i_j$ for $GC2^i_j$ used in the processing of second layer decoding section 206. Here, $GC3^i_j$ is a gain code vector constituting the gain codebook used in third layer decoding section 804.

Second layer decoded spectrum X2"(k) is inputted to adder 805 from second layer decoding section 803. Furthermore, third layer decoded spectrum X3"(k) is inputted to adder 805 from third layer decoding section 804. Adder 805 adds up inputted second layer decoded spectrum X2"(k) and third layer decoded spectrum X3"(k), and outputs the added spectrum as first addition spectrum X4"(k) to adder 806.

First addition spectrum X4"(k) is inputted to adder 806 from adder 805. Furthermore, first layer decoded spectrum X1"(k) is inputted to adder 806 from first layer decoding section 802. Adder 806 adds up inputted first addition spectrum X4"(k) and first layer decoded spectrum X1"(k) and outputs the added spectrum as second addition spectrum X5"(k) to orthogonal transform processing section 807.

Orthogonal transform processing section 807 initializes built-in buffer buf'(k) to initial value "0" by following equation 16.

$$buf'(k)=0(k=0,\ldots,N-1) \quad \text{(Equation 16)}$$

Orthogonal transform processing section 807 receives second addition spectrum X5"(k) as input and obtains output signal y"(n) according to equation 17 below.

(Equation 17)

$$y''(n)=\frac{2}{N}\sum_{n=0}^{2N-1}X6(k)\cos\left[\frac{(2n+1+N)(2k+1)\pi}{4N}\right] \quad [17]$$

$$(n=0,\ldots,N-1)$$

In this equation, X6(k) is a vector in which second addition spectrum X5"(k) and buffer buf'(k) are coupled, and X6(k) is obtained using following equation 18.

(Equation 18)

$$X6(k) = \begin{cases} buf'(k) & (k = 0, \ldots N-1) \\ X5''(k) & (k = N, \ldots 2N-1) \end{cases} \quad [18]$$

Then, orthogonal transform processing section 807 updates buffer buf'(k) according to following equation 19.

$$buf'(k)=X''5(k)(k=0, \ldots N-1) \quad \text{(Equation 19)}$$

Orthogonal transform processing section 807 outputs output signal y"(n).

The processing of decoding apparatus 103 has been described above.

The embodiment of the present invention has been described so far.

Thus, according to the present embodiment, first layer coding section 202 switches the coding method of the current layer based on the coding result of each layer in a preceding processing frame. Thus, when a hierarchical coding scheme is used in which coding apparatus 101 selects a band of a coding target for each hierarchy (layer), it is possible to improve the coding efficiency of frequency parameters in the current frame and as a result, improve the quality of the decoded signal.

The present embodiment has described the configuration in which only first layer coding section 202 which is the lowest layer is provided with adaptive prediction determination section 303 and it is determined whether or not predictive coding/decoding is applied to coding/decoding of first layer gain information. However, the present invention is not limited to this. That is, the present invention is likewise applicable to a configuration in which second layer coding section 205 and third layer coding section 208 which are higher layers are provided with adaptive prediction determination section 303. By also adaptively performing predictive coding/decoding processing on the second and higher layers, it is possible to accurately encode frequency parameters. However, to increase coding efficiency without drastically increasing the amount of calculation, the configuration in which adaptive predictive coding/decoding processing is performed only on some layers (e.g., lowest layer) is effective, as described in the present embodiment.

The present embodiment has described the configuration in which first layer coding section 202 calculates and transmits prediction information. In the present embodiment, adaptive prediction determination section 303 sets prediction information using band information quantized in the processing frame one frame before the current frame and band information selected in the current frame. Here, the band information and prediction information can also be calculated by decoding apparatus 103 performing similar processing. Therefore, for the configuration using the above-described determination method, coding apparatus 101 need not transmit prediction information to decoding apparatus 103. In this case, the second layer band information and third layer band information need to be inputted to first layer decoding section 802 separately. Furthermore, first layer decoding section 802 needs to be provided with adaptive prediction determination section 303 and set prediction information as in the case of first layer coding section 202. However, the configuration in which prediction information is transmitted is effective for reducing the amount of calculation to set prediction information in decoding apparatus 103, as described in the present embodiment.

In the present embodiment, adaptive prediction determination section 303 determines prediction information using band information quantized in the processing frame one frame before the current frame and band information selected in the current frame. The present invention is not limited to this, but is likewise applicable to a configuration in which adaptive prediction determination section 303 uses band information quantized in a preceding frame two or more frames before the current frame.

Embodiment 2

Embodiment 2 of the present invention will describe a configuration in which coding section/decoding sections of all hierarchies (layers) apply an adaptive predictive coding/decoding scheme with an ideal gain (gain information). The adaptive predictive coding scheme described in the present embodiment is partially different from the adaptive predictive coding scheme described in Embodiment 1 in information of a past frame used for prediction.

A communication system (not shown) according to Embodiment 2 is basically identical to the communication system shown in FIG. 1 and the configuration and operation of its coding apparatus/decoding apparatus are only partially different from those of coding apparatus 101 and decoding apparatus 103. Hereinafter, the coding apparatus and decoding apparatus in the communication system according to the present embodiment will be described with reference numerals "111" and "113" assigned thereto.

Figure 9:
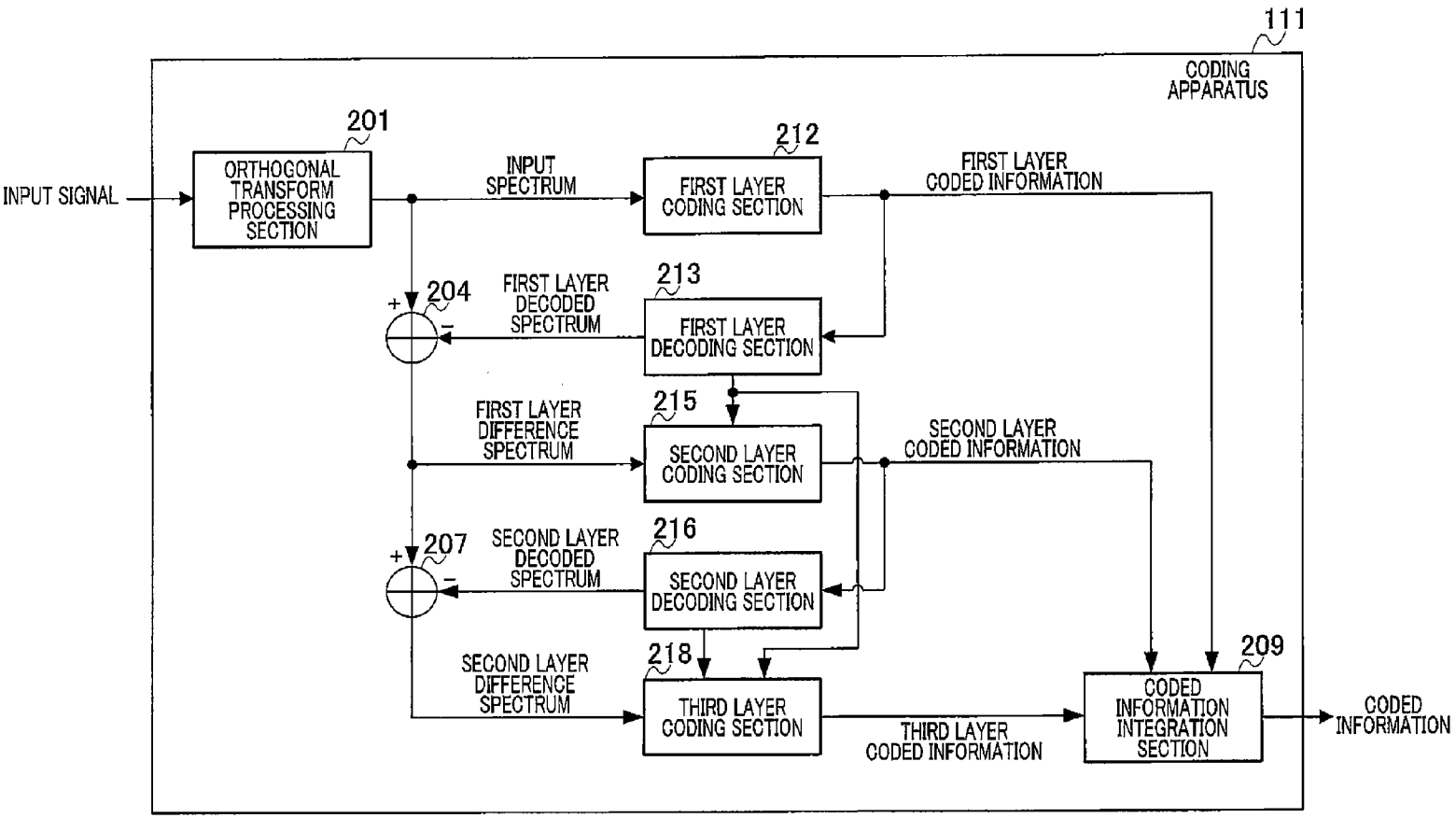
FIG. 9 is a block diagram illustrating a main internal configuration of a coding apparatus according to Embodiment 2 of the present invention.

FIG. 9 is a block diagram illustrating a main configuration of decoding apparatus 111 in FIG. 1. For example, it is assumed that coding apparatus 111 is a hierarchical coding apparatus including three coding hierarchies (layers). Here, it is assumed that the three layers are called a first layer, a second layer and a third layer in the ascending order of the bit rate. In coding apparatus 111, since components other than first layer coding section 212, first layer decoding section 213, second layer coding section 215, second layer decoding section 216, and third layer coding section 218 are identical to the components of coding apparatus 101 of Embodiment 1, these components are assigned with the same reference numerals and descriptions thereof will be omitted here.

Input spectrum X1(k) is inputted to first layer coding section 212 from orthogonal transform processing section 201. First layer coding section 212 encodes input spectrum X1(k) to generate first layer coded information. Next, first layer coding section 212 outputs the generated first layer coded information to first layer decoding section 213 and coded information integration section 209. The details of first layer coding section 212 will be described later.

First layer decoding section 213 decodes the first layer coded information inputted from first layer coding section 212, and calculates a first layer decoded spectrum. Next, first layer decoding section 213 outputs the generated first layer decoded spectrum to adder 204. Furthermore, first layer decoding section 213 outputs an ideal gain (gain information) obtained when decoding the first layer coded information to second layer coding section 215 and third layer coding section 218. The details of first layer decoding section 213 will be described later.

Second layer coding section 215 generates second layer coded information using a first layer difference spectrum inputted from adder 204 and outputs the generated second layer coded information to second layer decoding section 216, and coded information integration section 209. The details of second layer coding section 215 will be described later.

Second layer decoding section 216 decodes the second layer coded information inputted from second layer coding section 215, and calculates a second layer decoded spectrum. Next, second layer decoding section 216 outputs the generated second layer decoded spectrum to adder 207. Furthermore, second layer decoding section 215 outputs an ideal gain (gain information) obtained when decoding the second layer coded information, to third layer coding section 218. The details of second layer decoding section 216 will be described later.

Third layer coding section 218 generates third layer coded information using a second layer difference spectrum inputted from adder 207, and outputs the generated third layer coded information to coded information integration section 209. The details of third layer coding section 218 will be described later.

Figure 10:
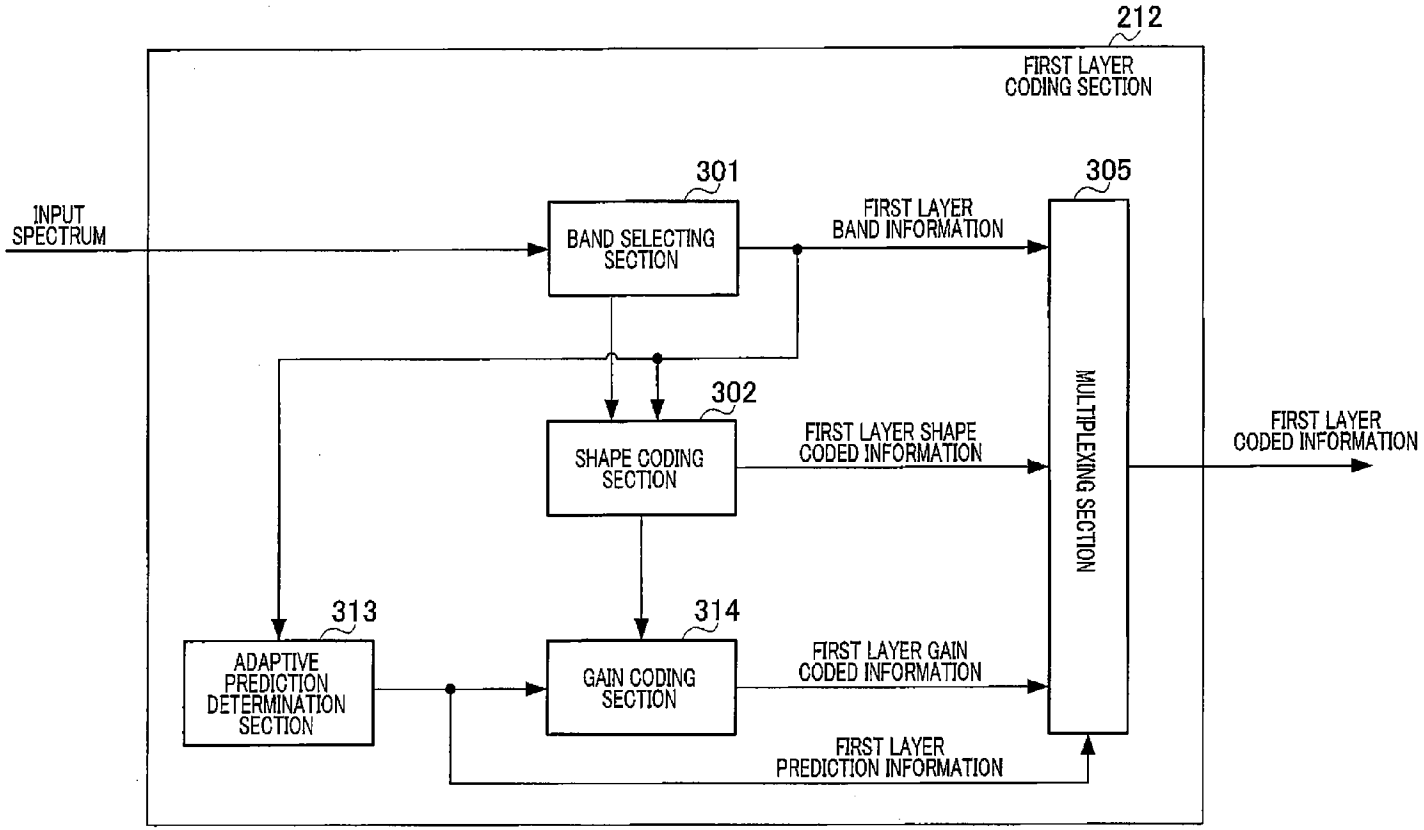
FIG. 10 is a block diagram illustrating a main internal configuration of the first layer coding section shown in FIG. 9.

FIG. 10 is a block diagram illustrating a main configuration of first layer coding section 212.

In FIG. 10, first layer coding section 212 includes band selecting section 301, shape coding section 302, adaptive prediction determination section 313, gain coding section 314, and multiplexing section 305. Here, components other than adaptive prediction determination section 313 and gain coding section 314 are identical to the components in first layer coding section 202 of Embodiment 1, and therefore these components are assigned with the same reference numerals and descriptions thereof will be omitted here.

First layer band information is inputted to adaptive prediction determination section 313 from band selecting section 301. Adaptive prediction determination section 313 includes an internal buffer that stores first layer band information inputted in the past from band selecting section 301.

Adaptive prediction determination section 313 obtains the number of sub-bands common between the quantization target band in the current frame and the quantization target band in the past frame using the inputted first layer band information. When the number of common sub-bands is equal to or more than a predetermined value, adaptive prediction determination section 313 determines that predictive coding is performed on the spectrum (MDCT coefficient) of the quantization target band indicated by the first layer band information. On the other hand, when the number of common sub-bands is less than the predetermined value, adaptive prediction determination section 313 determines that predictive coding is not performed on the spectrum (MDCT coefficient) of the quantization target band indicated by the first layer band information (that is, encoding without applying prediction thereto is performed).

Adaptive prediction determination section 313 outputs the determination result as first layer prediction information (Flag_PRE1) to gain coding section 314 and multiplexing section 305. Here, adaptive prediction determination section 313 sets the value of first layer prediction information Flag_PRE1 to 1 when determining that prediction is performed, and sets the value of first layer prediction information Flag_PRE1 to 0 when determining that prediction is not performed. The details of processing of adaptive prediction determination section 313 will be described later.

An ideal gain is inputted to gain coding section 314 from shape coding section 302. Furthermore, first layer prediction information is inputted to gain coding section 314 from adaptive prediction determination section 313.

When the first layer prediction information indicates a determination result that predictive coding is performed, gain coding section 314 performs predictive coding on the ideal gain inputted from shape coding section 302 to obtain the first layer gain coded information. At this time, gain coding section 314 performs predictive coding on the ideal gain using the quantization gain of the past frame stored in the built-in buffer and a built-in gain codebook to obtain first layer gain coded information.

On the other hand, when the first layer prediction information indicates a determination result that predictive coding is not performed, gain coding section 314 quantizes the ideal gain inputted from shape coding section 302 as is (that is, quantizes the ideal gain without applying prediction thereto) to obtain first layer gain coded information.

Gain coding section 314 outputs the obtained first layer gain coded information to multiplexing section 305. The details of processing of gain coding section 314 will be described later.

First layer coding section 212 having the above configuration is operated as follows. However, since the processing performed other than adaptive prediction determination section 313, and gain coding section 314 is identical to that of Embodiment 1, descriptions thereof will be omitted.

First layer band information in the current frame is inputted to adaptive prediction determination section 313 from band selecting section 301.

Adaptive prediction determination section 313 includes a built-in buffer that stores first layer band information in the past frame. The case that adaptive prediction determination section 313 incorporates a buffer that stores the pieces of first layer band information for the past one frame will be described below by way of example.

First of all, adaptive prediction determination section 313 calculates the number of sub-bands common between the quantization target band in the past frame and the quantization target band in the current frame using the first layer band information in the past frame and the first layer band information in the current frame.

Next, adaptive prediction determination section 313 determines that the predictive coding is performed when the number of common sub-bands is equal to or more than the predetermined value, and determines that the predictive coding is not performed when the number of common sub-bands is less than the predetermined value. To be more specific, adaptive prediction determination section 313 compares the sub-band (assumed to be set $M1_{t-1}$) indicated by the first layer band information in the processing frame one frame before the current frame with the L sub-bands (assumed to be set $M1_t$) indicated by the first layer band information in the current frame.

Adaptive prediction determination section 313 determines that the predictive coding is performed and sets Flag_PRE1=1 when the number of common sub-bands is equal to or more than P. On the other hand, when the number of common sub-bands is less than P, adaptive prediction determination section 313 determines that the predictive coding is not performed and sets Flag_PRE1=0.

Thus, adaptive prediction determination section 313 sets the value of first layer prediction information Flag_PRE1 as described above based on the number of common sub-bands among sub-bands included in $M1_t$ and $M1_{t-1}$. This allows the quantization method to be adaptively switched to one of the predictive coding method and the non-predictive coding method.

Next, adaptive prediction determination section 313 outputs the first layer prediction information (Flag_PRE1) as information indicating the determination result to gain coding section 314 and multiplexing section 305. Next, adaptive prediction determination section 313 updates the built-in buffer using the first layer band information in the current frame.

An ideal gain is inputted to gain coding section 314 from shape coding section 302. Furthermore, first layer prediction information (Flag_PRE1) is inputted to gain coding section 314 from adaptive prediction determination section 313.

Gain coding section 314 includes a built-in buffer that stores quantization gains obtained in past frames.

Gain coding section 314 adaptively switches the quantization method to one of a predictive coding method and a non-predictive coding method according to the first layer prediction information (Flag_PRE1).

[When Flag_PRE1=1]

In this case, gain coding section 314 performs predictive coding. That is, gain coding section 314 predicts the gain of the current frame using the quantization gain quantized in processing frames up to the frame three frames before the current frame stored in the built-in buffer, and the first layer gain coded information to thereby generate the quantization gain of the current frame. Specifically, gain coding section 314 searches the built-in gain codebook including the GQ gain code vectors in each of the L sub-bands, and obtains the index of the gain code vector in which square error Gain_q(i) of following equation 20 is minimized.

(Equation 20)

$$\text{Gain_q}(i) = \left\{ \sum_{j=0}^{L-1} \left\{ \begin{array}{c} \text{Gain_i}(j+j'') - \\ \sum_{t=1}^{3} \left( \alpha_t \cdot C1^t_{j+j''} \right) - \alpha_0 \cdot GC1^i_j \end{array} \right\} \right\}^2 \quad [20]$$

$$(i = 0, \ldots, GQ-1)$$

Where $GC1^i_j$ is the gain code vector constituting the gain codebook in first layer coding section 212, i is the index of the gain code vector, and j is the index of the element of the gain code vector. For example, j has values of 0 to 4 in the case that the number of sub-bands constituting the region is 5 (in the case of L=5). Here, $C1^t_j$ indicates the gain quantized in first layer coding section 212 t frames before the current frame. For example, in the case of t=1, $C1^1_j$ indicates the gain quantized in first layer coding section 212 one frame before the current frame. Furthermore, $\alpha_0$ to $\alpha_3$ are quartic linear prediction coefficients stored in gain coding section 314. Gain coding section 314 deals with the L sub-bands in one region as an L-dimensional vector to perform vector quantization.

In the case that the gain of the quantization target band in the past frame is not present in the built-in buffer, in equation 20 above, gain coding section 314 substitutes the gain of the sub-band closest to the quantization target in the current frame in terms of the frequency among gains stored in the built-in buffer.

[When Flag_PRE1=0]

In this case, gain coding section 314 performs non-predictive coding. To be more specific, gain coding section 314 directly quantizes ideal gain Gain_i(j) inputted from shape coding section 302 according to aforementioned equation 10. Gain coding section 314 deals with the ideal gain as the L-dimensional vector to perform the vector quantization.

Gain coding section 314 outputs index G_min of the gain code vector, in which square error Gain_q(i) in equation 20 or equation 10 above is minimized, as the first layer gain coded information, to multiplexing section 305.

Furthermore, gain coding section 314 updates the built-in buffer according to following equation 21 using first layer gain coded information G_min and quantization gain $C1^t_j$ obtained in the current frame.

(Equation 21)

$$\begin{cases} C1^3_{j+j''} = C1^2_{j+j''} \\ C1^2_{j+j''} = C1^1_{j+j''} \\ C1^1_{j+j''} = GC1^{G_min}_j \end{cases} \quad [21]$$

$$(j = 0, \ldots, L-1)$$

Figure 11:
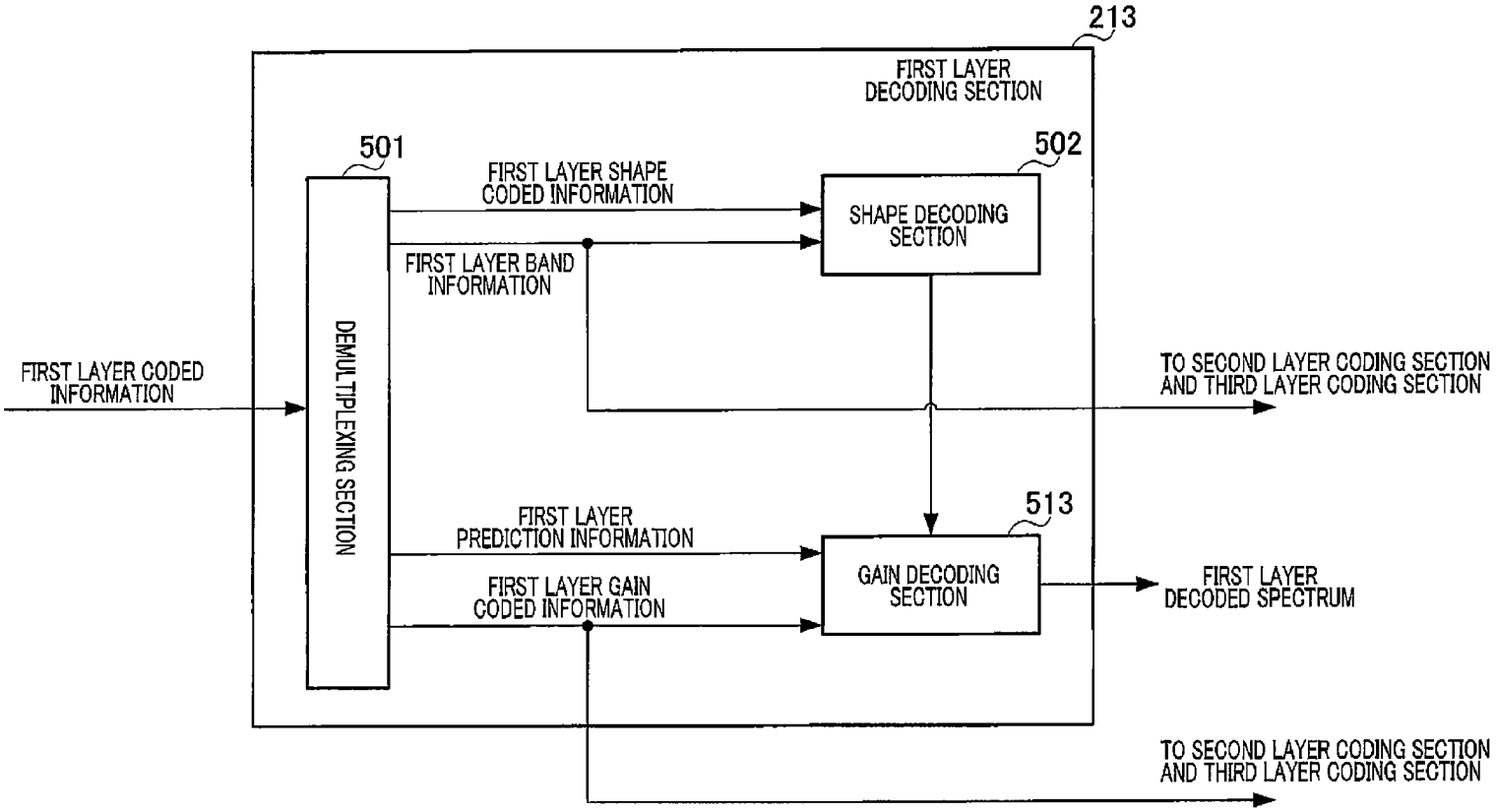
FIG. 11 is a block diagram illustrating a main internal configuration of the first layer decoding section shown in FIG. 9.

FIG. 11 is a block diagram illustrating a main configuration of first layer decoding section 213.

In FIG. 11, first layer decoding section 213 is provided with demultiplexing section 501, shape decoding section 502, and gain decoding section 513. Here, components other than gain decoding section 513 are identical to the components of first layer decoding section 203 described in Embodiment 1, and are therefore assigned with the same reference numerals and descriptions thereof will be omitted. However, demultiplexing section 501 in the present embodiment is only different from demultiplexing section 501 of Embodiment 1 in that the demultiplexed first layer band information and first layer gain coded information are outputted to second layer coding section 215 and third layer coding section 218.

First layer prediction information (Flag_PRE1) is inputted to gain decoding section 513 from demultiplexing section 501. Furthermore, the value of the shape of the MDCT coefficient is inputted to gain decoding section 513 from shape decoding section 502.

When the first layer prediction information indicates that predictive decoding is performed (that is, when Flag_PRE1=1), gain decoding section 513 performs predictive decoding on the gain coded information inputted from demultiplexing section 501 to obtain the gain. Here, gain decoding section 513 performs predictive decoding on the first layer gain coded information using the first layer gain coded information, the gain of the past frame stored in the built-in buffer and the built-in gain codebook.

On the other hand, when the first layer prediction information indicates that predictive decoding is not performed (that is, when Flag_PRE1=0), gain decoding section 513 dequantizes the first layer gain coded information as is (that is, without performing predictive decoding) using the built-in gain codebook to obtain the gain.

Gain decoding section 513 obtains the MDCT coefficient of the quantization target band using the obtained gain and the value of the shape inputted from shape decoding section 502, and outputs the obtained MDCT coefficient as the first layer decoded spectrum to adder 204. The details of processing of gain decoding section 513 will be described later.

First layer decoding section 213 having the above configuration is operated as follows. Here, only the processing of gain decoding section 513 will be described.

Gain decoding section 513 includes a built-in buffer that stores quantization gains obtained in past frames.

Gain decoding section 513 adaptively switches the dequantization method to one of a predictive decoding method and non-predictive decoding method according to the first layer prediction information (Flag_PRE1).

[When Flag_PRE1=1]

In this case, gain decoding section 513 performs predictive decoding. That is, gain decoding section 513 predicts the gain of the current frame using the gain of the past frame stored in the built-in buffer to thereby perform dequantization. To be more specific, gain decoding section 513 incorporates a gain codebook similar to that of gain coding section 314 of first layer coding section 212, and dequantizes the gain according to equation 22 below to obtain gain Gain_q'.

(Equation 22)

$$\text{Gain_q}'(j+j'') = \sum_{t=1}^{3}\left(\alpha_t \cdot C1''^{t}_{j+j''}\right) + \alpha_0 \cdot GC1_j^{G_min} \quad [22]$$

$$(j = 0, \ldots, L-1)$$

Here, $C1''^{t}_{j}$ indicates the value of the gain dequantized in first layer decoding section 213 t frames before the current frame. For example, in the case of t=1, $C1''^{1}_{j}$ indicates the gain dequantized in first layer decoding section 213 one frame before the current frame. Furthermore, $\alpha_0$ to $\alpha_3$ are quartic linear prediction coefficients stored in gain coding section 513. Gain decoding section 513 deals with the L sub-bands in one region as the L-dimensional vector to perform vector dequantization.

When no gain in the decoding target band in the past frame exists in the built-in buffer, in equation 22, gain decoding section 513 substitutes the gain of the sub-band closest to the decoding target band in the current frame in terms of the frequency among gains stored in the built-in buffer.

[When Flag_PRE1=0]

In this case, gain decoding section 513 performs non-predictive decoding. That is, gain decoding section 513 dequantizes the gain value according to equation 13 using the above-described gain codebook. Here, gain decoding section 513 also deals with the gain as the L-dimensional vector to perform the vector dequantization. That is, in the case that the predictive decoding is not performed, gain decoding section 513 directly uses gain code vector $GC1_j^{G_min}$ corresponding to first layer gain coded information G_min as the gain.

Next, gain decoding section 513 calculates first layer decoded spectrum (decoded MDCT coefficient) X1"(k) according to equation 14 using the gain obtained by the dequantization of the current frame and the value of the shape inputted from shape decoding section 502. In the case that k exists in B(j") to B(j"+1)−1 during the dequantization of the MDCT coefficient, the gain has a value of Gain_q'(j").

Next, gain decoding section 513 updates the built-in buffer according to equation 21.

Gain decoding section 513 outputs calculated first layer decoded spectrum X1"(k) according to equation 14 to adder 204.

Figure 12:
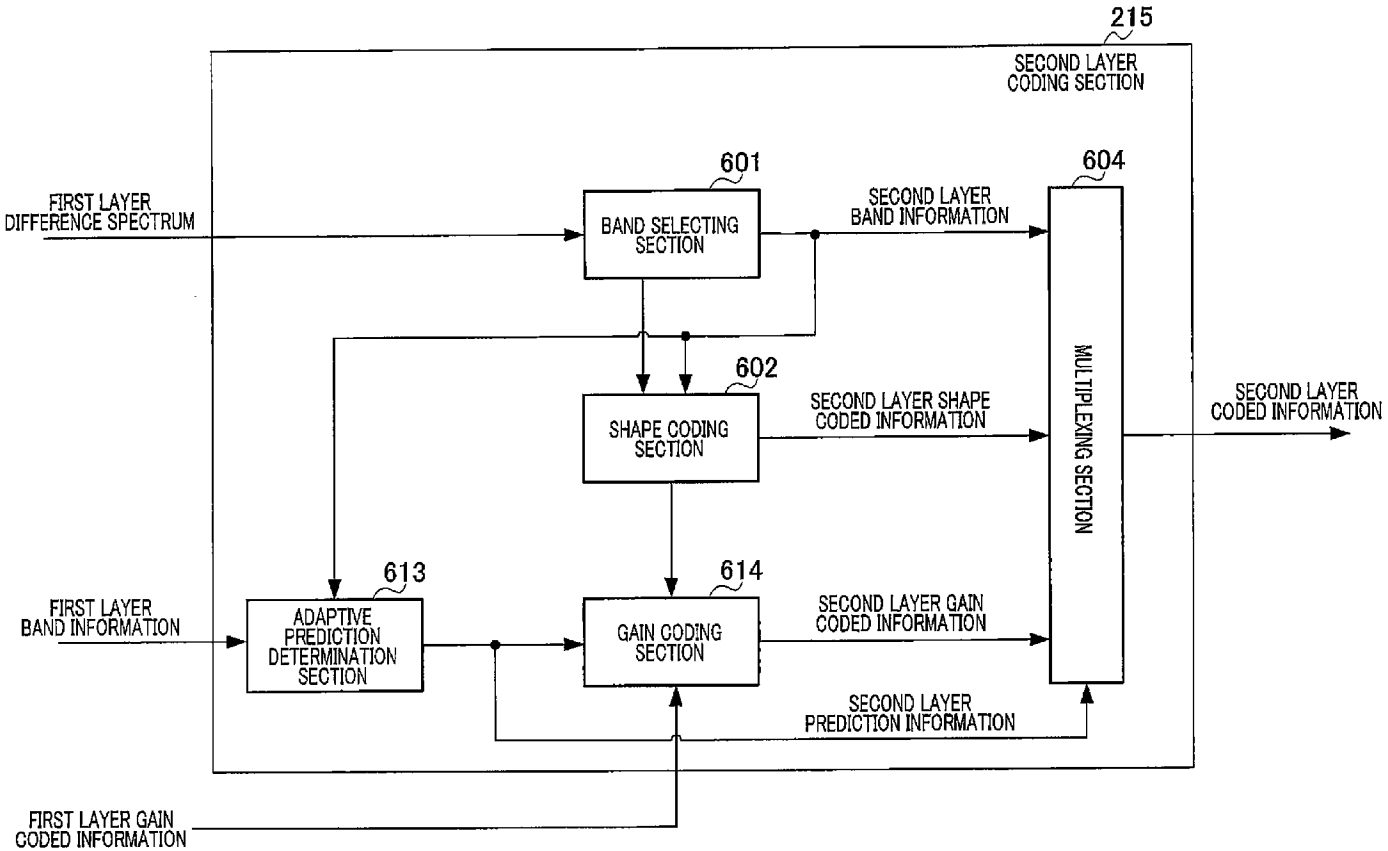
FIG. 12 is a block diagram illustrating a main internal configuration of the second layer coding section shown in FIG. 9.

FIG. 12 is a block diagram illustrating a main configuration of second layer coding section 215.

In FIG. 12, second layer coding section 215 includes band selecting section 601, shape coding section 602, adaptive prediction determination section 613, gain coding section 614, and multiplexing section 604. Here, components other than adaptive prediction determination section 613 and gain coding section 614 are identical to the components in second layer coding section 205 in Embodiment 1, and therefore these components are assigned with the same reference numerals and descriptions thereof will be omitted.

Adaptive prediction determination section 613 includes an internal buffer that stores band information inputted in the past from band selecting section 601 and first layer decoding section 213 (first layer band information and second layer band information). First layer band information is inputted to adaptive prediction determination section 613 from first layer decoding section 213. Furthermore, second layer band information is inputted to adaptive prediction determination section 613 from band selecting section 601.

Adaptive prediction determination section 613 obtains the number of sub-bands common between the quantization target band in the current frame and the quantization target band in the past frame using each piece of inputted band information (first layer band information, second layer band information).

When the number of common sub-bands is equal to or more than a predetermined value, adaptive prediction determination section 613 determines that predictive coding is performed on the spectrum (MDCT coefficient) of the quantization target band indicated by the second layer band information. On the other hand, when the number of common sub-bands is less than the predetermined value, adaptive prediction determination section 613 determines that predictive coding is not performed (that is, coding without applying prediction thereto is performed) on the spectrum (MDCT coefficient) of the quantization target band indicated by the second layer band information.

Adaptive prediction determination section 613 outputs the determination result as second layer prediction information (Flag_PRE2) to gain coding section 614 and multiplexing section 604. Here, adaptive prediction determination section 613 sets the value of Flag_PRE2 to 1 when determining that prediction is performed, and sets the value of Flag_PRE2 to 0 when determining that prediction is not performed. The details of processing of adaptive prediction determination section 613 will be described later.

Gain coding section 614 includes an internal buffer that stores quantization gains obtained in past frames.

An ideal gain is inputted to gain coding section 614 from shape coding section 602. Furthermore, first layer gain coded information is inputted to gain coding section 614 from first layer decoding section 213. Furthermore, second layer prediction information is inputted to gain coding section 614 from adaptive prediction determination section 613.

When the second layer prediction information indicates a determination result that predictive coding is performed, gain coding section 614 performs predictive coding on the ideal gain inputted from shape coding section 602 to obtain second layer gain coded information. At this time, gain coding section 614 performs predictive coding on the ideal gain using the quantization gain of the past frame stored in the built-in buffer, built-in gain codebook, and first layer gain coded information.

On the other hand, when the second layer prediction information indicates a determination result that predictive coding is not performed, gain coding section 614 quantizes the ideal gain inputted from shape coding section 602 as is (that is, performing quantization without applying prediction thereto).

Gain coding section 614 outputs the obtained second layer gain coded information to multiplexing section 604. The details of processing of gain coding section 614 will be described later.

Second layer coding section 215 having the above configuration is operated as follows. Here, only the processing of adaptive prediction determination section 613 and gain coding section 614 will be described here.

Adaptive prediction determination section 613 includes a built-in buffer that stores second layer band information and first layer band information in the past frame. A case will be described below by way of example where adaptive prediction determination section 613 incorporates a buffer that stores pieces of band information for the past one frame.

First layer band information in the current frame is inputted to adaptive prediction determination section 613 from first layer decoding section 213.

First of all, adaptive prediction determination section 613 obtains the number of sub-bands common between the quantization target band in the past frame and the quantization target band in the current frame using the first layer band information and second layer band information in the past frame (these are stored in the built-in buffer), and first layer band information and second layer band information in the current frame.

Next, adaptive prediction determination section 613 determines that predictive coding is performed when the number of common sub-bands is equal to or more than a predetermined value and adaptive prediction determination section 613 determines that predictive coding is not performed when the number of common sub-bands is less than the predetermined value. To be more specific, adaptive prediction determination section 613 compares the sub-band group (assumed to be set $M12_{t-1}$) of the union of the sub-band (assumed to be set $M2_{t-1}$) indicated by the second layer band information and the sub-band (assumed to be set $M1_{t-1}$) indicated by the first layer band information in the processing frame one frame before the current frame with the sub-band group (assumed to be set $M12_t$) of the union of the sub-band (assumed to be set $M1_t$) indicated by the first layer band information and the L sub-bands (assumed to be set $M2_t$) indicated by the second layer band information in the current frame.

Here, above set $M12_{t-1}$ can be expressed by equation 23 below using set $M1_{t-1}$ and set $M2_{t-1}$. Furthermore, set $M12_t$ can be expressed by equation 24 below using set $M1_t$ and set $M2_t$.

$$M12_{t-1}=M1_{t-1}\cup M2_{t-1} \quad \text{(Equation 23)}$$

$$M12_t=M1_t\cup M2_t \quad \text{(Equation 24)}$$

When the number of common sub-bands is equal to or more than P, adaptive prediction determination section 613 determines that predictive coding is performed and sets Flag_PRE2=1. On the other hand, when the number of common sub-bands is less than P, adaptive prediction determination section 613 determines that predictive coding is not performed and sets Flag_PRE2=0.

Thus, adaptive prediction determination section 613 sets the value of second layer prediction information Flag_PRE2, based on the number of common sub-bands among sub-bands included in $M12_{t-1}$ and $M12_t$, as described above. This allows the quantization method to be adaptively switched to one of the predictive coding method and the non-predictive coding method.

Next, adaptive prediction determination section 613 outputs second layer prediction information (Flag_PRE2) as the information indicating the determination result to gain coding section 614 and multiplexing section 604. Next, adaptive prediction determination section 613 updates the built-in buffer using the first layer band information and second layer band information in the current frame.

Gain coding section 614 includes an internal buffer that stores quantization gains obtained in past frames. Furthermore, first layer gain coded information is inputted to gain coding section 614 from first layer decoding section 213. Furthermore, second layer prediction information (Flag_PRE2) is inputted to gain coding section 614 from adaptive prediction determination section 613.

Gain coding section 614 switches the quantization method to one of the adaptively predictive coding method and non-predictive coding method according to the second layer prediction information (Flag_PRE2).

[When Flag_PRE2=1]

In this case, gain coding section 614 performs predictive coding. That is, gain coding section 614 predicts the gain in the current frame using the quantization gain quantized in processing frames up to the frame three frames before the current frame stored in the built-in buffer and first layer gain coded information in processing frames up to the frame three frames before the current frame to thereby generate a quantization gain in the current frame. Specifically, gain coding section 614 searches the built-in gain codebook including the GQ gain code vectors in each of the L sub-bands, and obtains the index of the gain code vector in which square error Gain_q(i) of following equation 25 is minimized.

(Equation 25)

$$\text{Gain_q}(i)=\left\{\sum_{j=0}^{L-1}\left\{\text{Gain_i}(j+j'')-\sum_{t=1}^{3}\left(\alpha_t\cdot\left(C1^t_{j+j''}+C2^t_{j+j''}\right)\right)-\alpha_0\cdot GC2^i_j\right\}\right\}^2 \quad [25]$$

$$(i=0,\ldots,GQ-1)$$

Where $GC2^i_j$ is the gain code vector constituting the gain codebook in second layer coding section 215, i is the index of the gain code vector, and j is the index of the element of the gain code vector. For example, j has values of 0 to 4 in the case that the number of sub-bands constituting the region is 5 (in the case of L=5).

Here, $C1^t_j$ indicates the gain quantized in first layer coding section 212 t frames before the current frame. For example, in the case of t=1, $C1^1_j$ indicates the gain quantized in first layer coding section 212 one frame before the current frame. Similarly, $C2^t_j$ indicates the gain quantized in second layer coding section 215 t frames before the current frame. Furthermore, $\alpha_0$ to $\alpha_3$ are quartic linear prediction coefficients stored in gain coding section 614. Gain coding section 614 deals with the L sub-bands in one region as an L-dimensional vector to perform vector quantization.

In the case that the gain of the quantization target band in the past frame is not present in the built-in buffer, in equation 25 above, gain coding section 614 substitutes the gain of the sub-band closest to the quantization target band in the current frame in terms of the frequency among gains stored in the built-in buffer.

[When Flag_PRE2=0]

In this case, gain coding section 614 performs non-predictive coding. To be more specific, gain coding section 614 directly quantizes ideal gain Gain_i(j) inputted from shape coding section 602 according to equation 26 below. Gain coding section 614 deals with the ideal gain as the L-dimensional vector to perform the vector quantization.

(Equation 26)

$$\text{Gain_q}(i)=\left\{\sum_{j=0}^{L-1}\{\text{Gain_i}(j+j'')-GC2^i_j\}\right\}^2 \quad [26]$$

$$(i=0,\ldots,GQ-1)$$

Gain coding section 614 outputs index G_min of the gain code vector, in which square error Gain_q(i) in equation 25 above is minimized, as the second layer gain coded information, to multiplexing section 604.

Furthermore, gain coding section 614 updates the built-in buffer according to equation 27 below using second layer gain coded information G_min obtained in the current frame and quantization gains $C1^t_j$ and $C2^t_j$.

(Equation 27)

$$\begin{cases} C1''^3_j = C1''^2_j \\ C1''^2_j = C1''^1_j \\ C1''^1_j = GC1_j^{G_min} \\ C2''^3_j = C2''^2_j \\ C2''^2_j = C2''^1_j \\ C2''^1_j = GC2_j^{G_min} \end{cases} \quad [27]$$

$$(j = j'', \ldots, j'' + L - 1)$$

Figure 13:
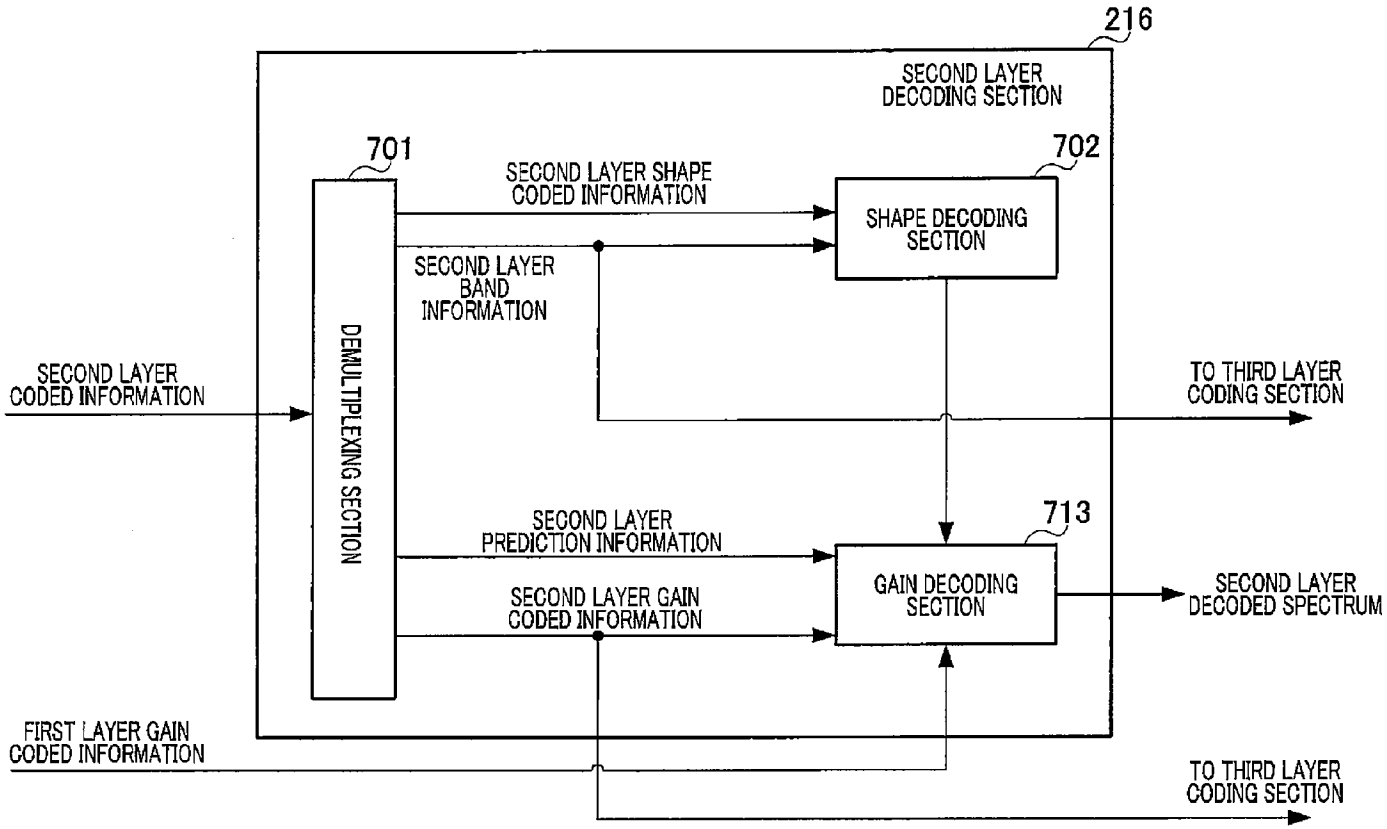
FIG. 13 is a block diagram illustrating a main internal configuration of the second layer decoding section shown in FIG. 9.

FIG. 13 is a block diagram illustrating a main configuration of second layer decoding section 216.

In FIG. 13, second layer decoding section 216 includes demultiplexing section 701, shape decoding section 702, and gain decoding section 713. Here, components other than gain decoding section 713 are identical to the components of second layer decoding section 206 described in Embodiment 1, and are therefore assigned with the same reference numerals and descriptions thereof will be omitted. However, demultiplexing section 701 in the present embodiment is only different from demultiplexing section 701 according to Embodiment 1 in that demultiplexed second layer band information, and second layer gain coded information are outputted to third layer coding section 218.

Second layer prediction information (Flag_PRE2) and second layer gain coded information are inputted to gain decoding section 713 from demultiplexing section 701. Furthermore, the value of the shape of the MDCT coefficient is inputted to gain decoding section 713 from shape decoding section 702.

When the second layer prediction information indicates that predictive decoding is performed (that is, when Flag_PRE2=1), gain decoding section 713 performs predictive decoding on the gain coded information inputted from demultiplexing section 701 to obtain the gain. Here, gain decoding section 713 performs predictive decoding on the second layer gain coded information using the second layer gain coded information, gains in past frames stored in the built-in buffer and the built-in gain codebook.

On the other hand, when the second layer prediction information indicates that predictive decoding is not performed (that is, when Flag_PRE2=0), gain decoding section 713 dequantizes the second layer gain coded information as is (that is, without performing predictive decoding) using the built-in gain codebook to obtain the gain. Gain decoding section 713 obtains the MDCT coefficient of the quantization target band using the obtained gain and the value of the shape inputted from shape decoding section 702, and outputs the obtained MDCT coefficient as the second layer decoded spectrum to adder 207.

Second layer decoding section 216 having the above configuration is operated as follows. Here, only the processing of gain decoding section 713 will be described.

Gain decoding section 713 includes a built-in buffer that stores gains obtained in past frames.

Gain decoding section 713 adaptively switches the dequantization method to one of the predictive decoding method and the non-predictive decoding method according to the second layer prediction information (Flag_PRE2).

[When Flag_PRE2=1]

In this case, gain decoding section 713 performs predictive decoding. That is, gain decoding section 713 predicts the gain of the current frame using gains of past frames stored in the built-in buffer to thereby perform dequantization. To be more specific, gain decoding section 713 incorporates a gain codebook similar to that of gain coding section 614 of second layer coding section 215, and dequantizes the gain according to equation 28 below to obtain gain Gain_q'.

(Equation 28)

$$\text{Gain_q}'(j + j'') = \sum_{t=1}^{3} \left(\alpha_i \cdot \left(C1''^t_{j+j''} + C2''^t_{j+j''}\right)\right) + \alpha_0 \cdot GC2_j^{G_min} \quad [28]$$

$$(j = 0, \ldots, L - 1)$$

Here, $C1''^t_j$ indicates the value of the gain dequantized in first layer decoding section 213 t frames before the current frame. For example, in the case of t=1, $C1''^1_j$ indicates the gain dequantized in first layer decoding section 213 one frame before the current frame. Furthermore, $C2''^t_j$ likewise indicates the value of the gain dequantized in second layer decoding section 215. Furthermore, $\alpha_0$ to $\alpha_3$ are quartic linear prediction coefficients stored in gain decoding section 713. Gain decoding section 713 deals with the L sub-bands in one region as the L-dimensional vector to perform vector dequantization.

In the case that the gain in the decoding target band of the past frame is not present in the built-in buffer, in equation 28, gain decoding section 713 substitutes the gain of the sub-band closest to the decoding target band in the current frame in terms of the frequency among gains stored in the built-in buffer.

[When Flag_PRE2=0]

In this case, gain decoding section 713 performs non-predictive decoding. That is, gain decoding section 713 dequantizes the gain value according to equation 29 below using the above-described gain codebook. Here, gain decoding section 713 also deals with the gain as the L-dimensional vector to perform the vector dequantization. That is, in the case that the predictive decoding is not performed, gain decoding section 713 directly uses gain code vector $GC2_j^{G_min}$ corresponding to second layer gain coded information G_min as the gain.

$$\text{Gain_q}'(j+j'') = GC2_j^{G_min} (j=0, \ldots, L-1) \quad \text{(Equation 29)}$$

Next, gain decoding section 713 calculates second layer decoded spectrum (decoded MDCT coefficient) X2"(k) according to equation 30 below using the gain obtained by the dequantization of the current frame, and the value of the shape inputted from shape decoding section 702. In the case that k exists in B(j") to B(j"+1)-1 during the dequantization of the MDCT coefficient, the gain has a value of Gain_q'(j").

(Equation 30)

$$X2''(k) = \text{Gain_q}'(j) \cdot \text{Shape_q}'(k) \quad [30]$$

$$\begin{pmatrix} k = B(j''), \ldots, B(j'' + L) - 1 \\ j = j'', \ldots, j'' + L - 1 \end{pmatrix}$$

Next, gain decoding section 713 updates the built-in buffer according to equation 27.

Gain decoding section 713 outputs calculated second layer decoded spectrum X2"(k) to adder 207 according to equation 30.

Figure 14:
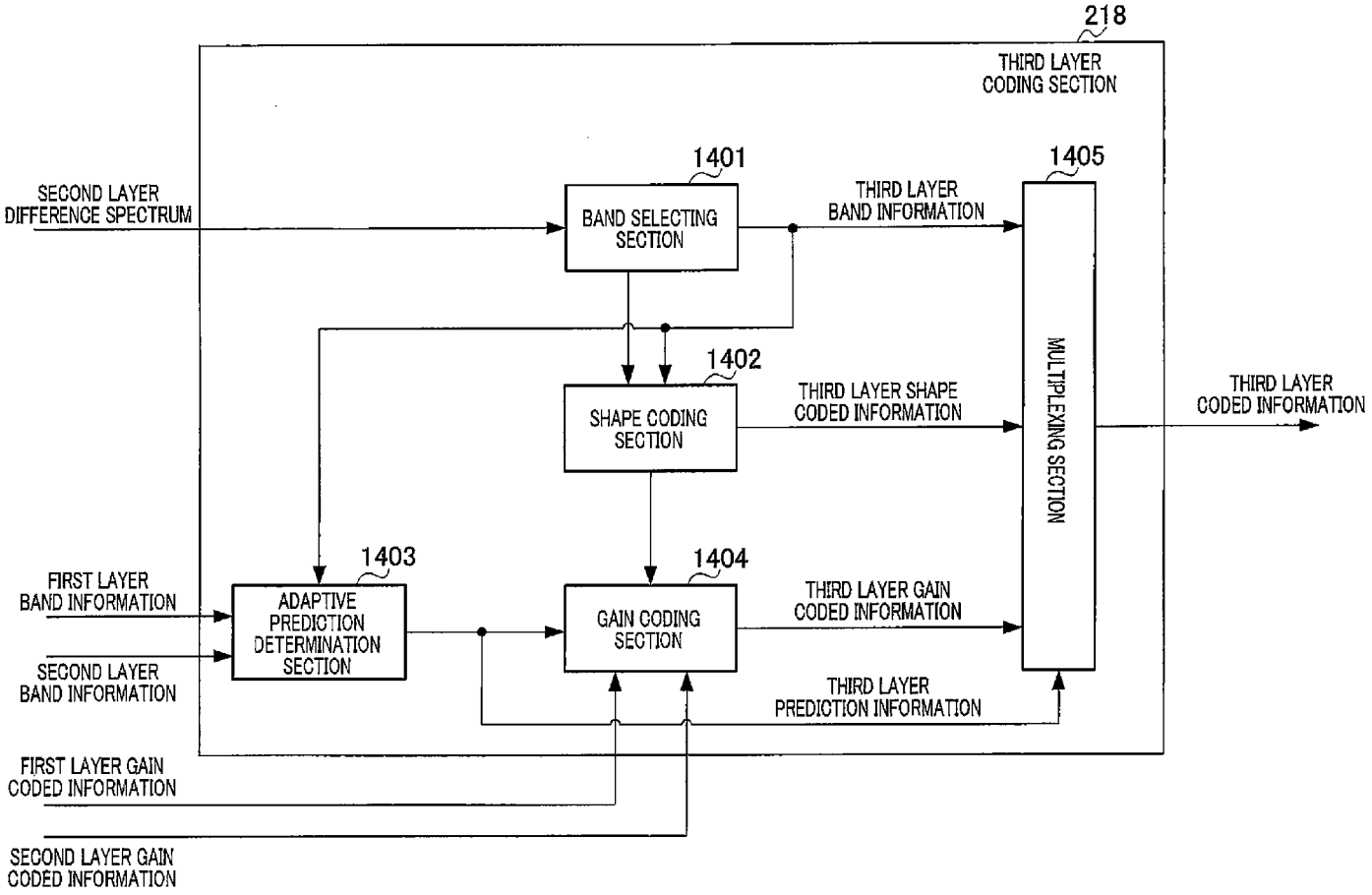
FIG. 14 is a block diagram illustrating a main internal configuration of the third layer coding section shown in FIG. 9.

FIG. 14 is a block diagram illustrating a main configuration of third layer coding section 218.

In FIG. 14, third layer coding section 218 includes band selecting section 1401, shape coding section 1402, adaptive prediction determination section 1403, gain coding section 1404, and multiplexing section 1405. Here, band selecting section 1401, shape coding section 1402, and multiplexing section 1405 are identical to those components in second layer coding section 205 in Embodiment 1 except that the terms of inputted/outputted information are different, and therefore descriptions thereof will be omitted.

Third layer band information is inputted to adaptive prediction determination section 1403 from band selecting section 1401. Furthermore, first layer band information is inputted to adaptive prediction determination section 1403 from first layer decoding section 213. Furthermore, second layer band information is inputted to adaptive prediction determination section 1403 from second layer decoding section 216.

Adaptive prediction determination section 1403 includes an internal buffer that stores band information (third layer band information, first layer band information, and second layer band information) inputted from band selecting section 1401, first layer decoding section 213, and second layer decoding section 216 in the past.

Adaptive prediction determination section 1403 obtains the number of sub-bands common between the quantization target band in the current frame and the quantization target band in the past frame using the inputted band information (first layer band information, second layer band information, third layer band information). When the number of common sub-bands is more than a predetermined value, adaptive prediction determination section 1403 determines that predictive coding is performed on the spectrum (MDCT coefficient) of the quantization target band indicated by the third layer band information. On the other hand, when the number of common sub-bands is less than the predetermined value, adaptive prediction determination section 1403 determines that the predictive coding is not performed on the spectrum (MDCT coefficient) of the quantization target band indicated by the third layer band information (that is, coding to which prediction is not applied is performed).

Adaptive prediction determination section 1403 outputs the determination result as the third layer prediction information (Flag_PRE3) to gain coding section 1404 and multiplexing section 1405. Here, adaptive prediction determination section 1403 sets the value of Flag_PRE3 to 1 when determining that prediction is performed, and sets the value of Flag_PRE3 to 0 when determining that prediction is not performed. The details of processing of adaptive prediction determination section 1403 will be described later.

An ideal gain is inputted to gain coding section 1404 from shape coding section 1402. Furthermore, third layer prediction information is inputted to gain coding section 1404 from adaptive prediction determination section 1403. Furthermore, first layer gain coded information is inputted to gain coding section 1404 from first layer decoding section 213. Second layer gain coded information is inputted to gain coding section 1404 from second layer decoding section 216.

When the third layer prediction information indicates a determination result that predictive coding is performed, gain coding section 1404 performs predictive coding on the ideal gain inputted from shape coding section 1402 to obtain third layer gain coded information. At this time, gain coding section 1404 performs predictive coding on the ideal gain using the quantization gain of the past frame stored in the built-in buffer, built-in gain codebook, first layer gain coded information, and second layer gain coded information to obtain the third layer gain coded information.

On the other hand, when the third layer prediction information indicates a determination result that predictive coding is not performed, gain coding section 1404 quantizes the ideal gain inputted from shape coding section 1402 as is (that is, performs quantization without applying prediction thereto).

Gain coding section 1404 outputs the obtained third layer gain coded information to multiplexing section 1405. The details of processing of gain coding section 1404 will be described later.

Third layer coding section 218 having the above configuration is operated as follows. Here, only the processing of adaptive prediction determination section 1403 and gain coding section 1404 will be described.

First layer band information is inputted to adaptive prediction determination section 1403 from first layer decoding section 213. Furthermore, second layer band information is inputted to adaptive prediction determination section 1403 from second layer decoding section 216. Furthermore, third layer band information is inputted to adaptive prediction determination section 1403 from band selecting section 1401.

Adaptive prediction determination section 1403 includes a built-in buffer that stores third layer band information, first layer band information, and second layer band information in the past frame. Here, a case will be described by way of example where adaptive prediction determination section 1403 incorporates a buffer that stores the pieces of band information for the past one frame.

First of all, adaptive prediction determination section 1403 obtains the number of sub-bands common between the quantization target band in the past frame and the quantization target band in the current frame using the third layer band information, first layer band information and second layer band information (these are stored in the built-in buffer) in the past frame and the third layer band information, first layer band information and second layer band information in the current frame.

Next, adaptive prediction determination section 1403 determines that predictive coding is performed when the number of common sub-bands is equal to or more than a predetermined value, and determines that predictive coding is not performed when the number of common sub-bands is less than the predetermined value. To be more specific, adaptive prediction determination section 1403 compares the sub-band group (assumed to be set $M123_{t-1}$) of the union of the sub-band (assumed to be set $M1_{t-1}$) indicated by the first layer band information, the sub-band (assumed to be set $M2_{t-1}$) indicated by the second layer band information and the sub-band (assumed to be set $M3_{t-1}$) indicated by the third layer band information in the processing frame one frame before the current frame with the sub-band group (assumed to be set $M123_1$) of the union of the sub-band (assumed to be set $M1_t$) indicated by the first layer band information, the sub-band (assumed to be set $M2_t$) indicated by the second layer band information and the L sub-bands (assumed to be set $M3_t$) indicated by the third layer band information in the current frame.

Here, above-described set $M123_{t-1}$ can be expressed by equation 31 below using set $M1_{t-1}$, set $M2_{1-1}$, and set $M3_{t-1}$. Furthermore, set $M123_t$ can be expressed by equation 32 below using set $M1_t$, set $M2_t$, and set $M3_t$.

$$M123_{t-1}=M1_{t-1}\cup M2_{t-1}\cup M3_{t-1} \quad \text{(Equation 31)}$$

$$M123_t=M1,\cup M2_t\cup M3_t \quad \text{(Equation 32)}$$

When the number of common sub-bands is equal to or more than P, adaptive prediction determination section 1403 determines that predictive coding is performed and sets Flag_PRE3=1. On the other hand, when the number of common sub-bands is less than P, adaptive prediction determination section 1403 determines that predictive coding is not performed and sets Flag_PRE3=0.

Thus, adaptive prediction determination section 1403 sets the value of third layer prediction information Flag_PRE3, based on the number of common sub-bands among sub-bands included in M123$_{t-1}$ and M123$_t$, as described above. This allows the quantization method to be adaptively switched to one of the predictive coding method and the non-predictive coding method.

Next, adaptive prediction determination section 1403 outputs third layer prediction information (Flag_PRE3) as the information indicating the determination result to gain coding section 1404 and multiplexing section 1405. Next, adaptive prediction determination section 1403 updates the built-in buffer using the third layer band information, first layer band information, and second layer band information in the current frame.

Furthermore, first layer gain coded information is inputted to gain coding section 1404 from first layer decoding section 213. Furthermore, second layer gain coded information is inputted to gain coding section 1404 from second layer decoding section 216. Furthermore, third layer prediction information (Flag_PRE3) is inputted to gain coding section 1404 from adaptive prediction determination section 1403.

Gain coding section 1404 includes an internal buffer that stores quantization gains obtained in past frames.

Gain coding section 1404 adaptively switches the quantization method to one of the predictive coding method and the non-predictive coding method according to the third layer prediction information (Flag_PRE3).

[When Flag_PRE3=1]

In this case, gain coding section 1404 performs predictive coding. That is, gain coding section 1404 predicts the gain of the current frame using the quantization gain quantized in third layer coding section 218 in processing frames up to the frame three frames before the current frame stored in the built-in buffer, first layer gain coded information in processing frames up to the frame three frames before the current frame and second layer gain coded information in processing frames up to the frame three frames before the current frame to thereby generate the quantization gain of the current frame. Specifically, gain coding section 1404 searches the built-in gain codebook including the GQ gain code vectors in each of the L sub-bands, and obtains the index of the gain code vector in which square error Gain_q(i) of following equation 33 is minimized.

(Equation 33)

$$\text{Gain_q}(i) = \left\{\sum_{j=0}^{L-1}\left\{\text{Gain_i}(j+j'') - \sum_{t=1}^{3}\left(\alpha_t\cdot\left(C1^t_{j+j''} + C2^t_{j+j''} + C3^t_{j+j''}\right)\right) - \alpha_0\cdot GC2^i_j\right\}\right\}^2 \quad (i = 0, \ldots, GQ-1) \qquad [33]$$

Where GC3$^i_j$ is the gain code vector constituting the gain codebook in third layer coding section 218, i is the index of the gain code vector, and j is the index of the element of the gain code vector. For example, j has values of 0 to 4 in the case that the number of sub-bands constituting the region is 5 (in the case of L=5).

Here, C1$^t_j$ indicates the gain quantized in first layer coding section 212 t frames before the current frame. For example, in the case of t=1, C1$^1_j$ indicates the gain quantized in first layer coding section 212 one frame before the current frame. Similarly, C2$^t_j$ indicates the gain quantized in second layer coding section 215 t frames before the current frame. Similarly, C3$^t_j$ indicates the gain quantized in third layer coding section 218 t frames before the current frame. Furthermore, $\alpha_0$ to $\alpha_3$ are quartic linear prediction coefficients stored in gain coding section 1404. Gain coding section 1404 deals with the L sub-bands in one region as an L-dimensional vector to perform vector quantization.

In the case that the gain of the quantization target band in the past frame is not present in the built-in buffer, in equation 33, gain coding section 1404 substitutes the gain of the sub-band closest to the quantization target band in the current frame in terms of the frequency among gains stored in the built-in buffer.

[When Flag_PRE3=0]

In this case, gain coding section 1404 performs non-predictive coding. To be more specific, gain coding section 1404 directly quantize ideal gain Gain_i(j) inputted from shape coding section 1402 according to equation 35 below. Gain coding section 1404 deals with the ideal gain as the L-dimensional vector to perform the vector quantization.

(Equation 34)

$$\text{Gain_q}(i) = \left\{\sum_{j=0}^{L-1}\{\text{Gain_i}(j+j'') - GC3^i_j\}\right\}^2 \quad (i = 0, \ldots, GQ-1) \qquad [34]$$

Gain coding section 1404 outputs index G_min of the gain code vector, in which square error Gain_q(i) of equation 33 or equation 34 above is minimized, as the third layer gain coded information to multiplexing section 1405.

Furthermore, gain coding section 1404 updates the built-in buffer according to equation 35 below using third layer gain coded information and quantization gains C1$^t_j$, C2$^t_j$ and C3$^t_j$ obtained in the current frame.

(Equation 35)

$$\begin{cases} C1''^3_j = C1''^2_j \\ C1''^2_j = C1''^1_j \\ C1''^1_i = GC1^{G_min}_j \\ C2''^3_j = C2''^2_j \\ C2''^2_j = C2''^1_j \\ C2''^1_j = GC2^{G_min}_j \\ C3''^3_j = C3''^2_j \\ C3''^2_j = C3''^1_j \\ C3''^1_j = GC3^{G_min}_j \end{cases} \quad (j = j'', \ldots, j''+L-1) \qquad [35]$$

The processing of coding apparatus 111 has been described above.

Figure 15:
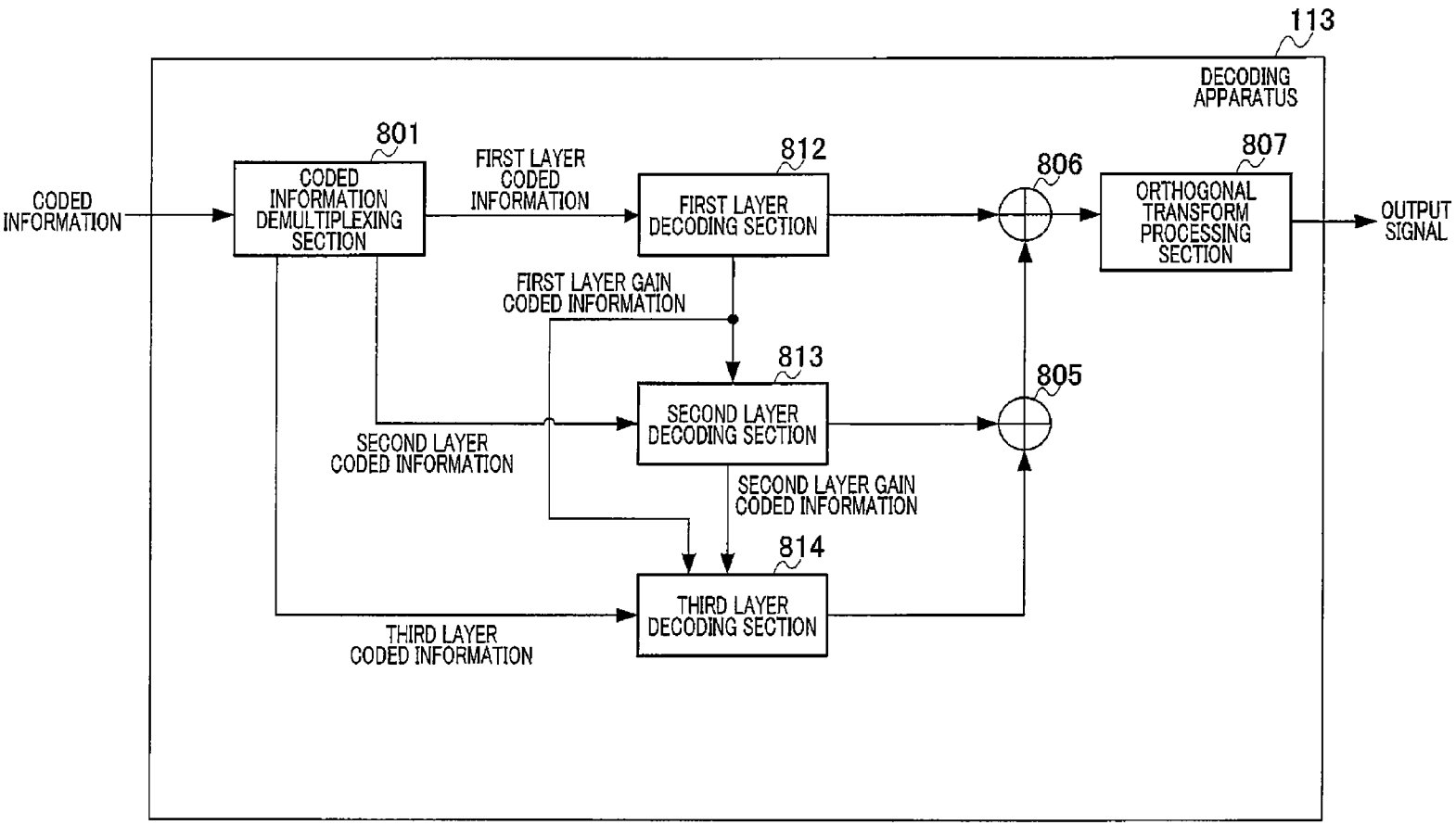
FIG. 15 is a block diagram illustrating a main internal configuration of a decoding apparatus according to Embodiment 2.

FIG. 15 is a block diagram illustrating a main internal configuration of decoding apparatus 113 of the present embodiment. For example, it is assumed that decoding apparatus 113 is a hierarchical decoding apparatus including three decoding hierarchies (layers). At this point, similarly to coding apparatus 111, it is assumed that the three layers are called a first layer, a second layer and a third layer in the ascending order of the bit rate. Components other than first layer decoding section 812, second layer decoding section 813, and third layer decoding section 814 among the components in coding apparatus 111 are identical to the components in decoding apparatus 103 of Embodiment 1, and therefore descriptions thereof will be omitted here.

First layer decoding section 812 decodes the first layer coded information inputted from coded information demultiplexing section 801 to generate first layer decoded spectrum X1"(k), and outputs generated first layer decoded spectrum X1"(k) to adder 806. Since the processing of first layer decoding section 812 is identical to the processing of first layer decoding section 213 in coding apparatus 111, descriptions thereof will be omitted.

Second layer decoding section 813 decodes the second layer coded information inputted from coded information demultiplexing section 801 to generate second layer decoded spectrum X2"(k) and outputs generated second layer decoded spectrum X2"(k) to adder 805. Since the processing of first layer decoding section 812 is identical to the processing of second layer decoding section 216 in coding apparatus 111, descriptions thereof will be omitted.

Third layer decoding section 814 decodes the third layer coded information inputted from coded information demultiplexing section 801 to generate third layer decoded spectrum X3"(k), and outputs generated third layer decoded spectrum X3"(k) to adder 805. The details of the processing of third layer decoding section 814 will be described later.

Figure 16:
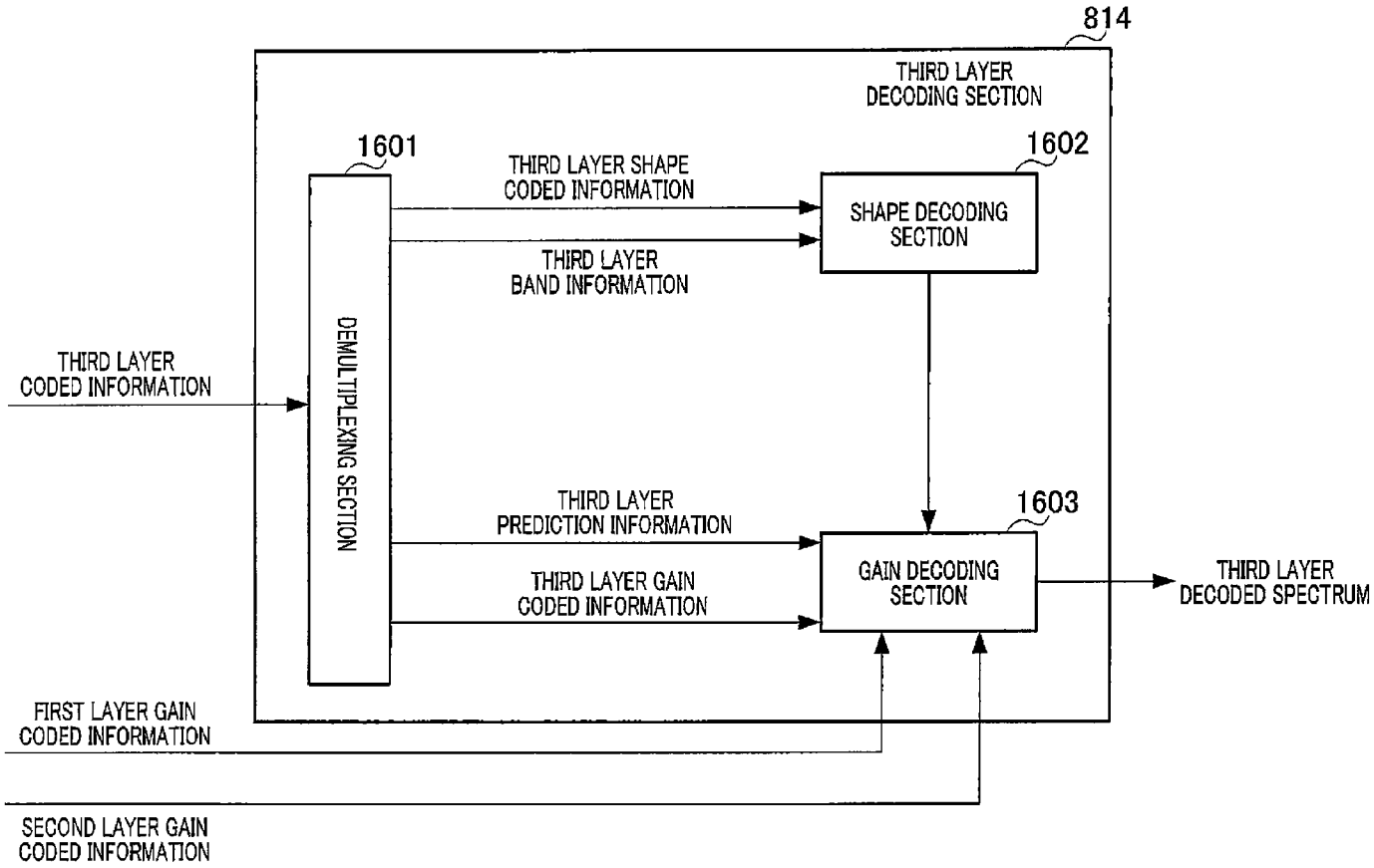
FIG. 16 is a block diagram illustrating a main internal configuration of the third layer decoding section shown in FIG. 15.

FIG. 16 is a block diagram illustrating a main internal configuration of third layer decoding section 814. Third layer decoding section 814 is mainly configured with demultiplexing section 1601, shape decoding section 1602, and gain decoding section 1603.

Demultiplexing section 1601 demultiplexes the third layer coded information outputted from coded information demultiplexing section 801 into third layer band information, third layer shape coded information, third layer gain coded information, and third layer prediction information. Demultiplexing section 1601 outputs the obtained third layer band information and third layer shape coded information to shape decoding section 1602, and outputs the third layer gain coded information and third layer prediction information to gain decoding section 1603.

Shape decoding section 1602 decodes the third layer shape coded information inputted from demultiplexing section 1601 to thereby obtain the value of the shape of the MDCT coefficient corresponding to the quantization target band indicated by the third layer band information inputted from demultiplexing section 1601. Shape decoding section 1602 outputs the obtained value of the shape of the DCT coefficient to gain decoding section 1603. Since the processing of shape 15, decoding section 1602 is identical to that of shape decoding section 502 of Embodiment 1, descriptions thereof will be omitted here.

Third layer gain coded information and third layer prediction information are inputted to gain decoding section 1603 from demultiplexing section 1601. Furthermore, the first layer gain coded information is inputted to gain decoding section 1603 from first layer decoding section 812. Furthermore, the second layer gain coded information is inputted to gain decoding section 1603 from second layer decoding section 813.

When the third layer prediction information indicates that predictive decoding is performed (that is, when Flag_PRE3=1), gain decoding section 1603 performs predictive decoding on the third layer gain coded information to obtain the gain. Here, gain decoding section 1603 performs predictive decoding on the third layer gain coded information using the first layer gain coded information, second layer gain coded information, gains in past frames stored in the built-in buffer and the built-in gain codebook.

On the other hand, when the third layer prediction information indicates that predictive decoding is not performed (that is, when Flag_PRE=0), gain decoding section 1603 dequantizes the third layer gain coded information as is (that is, without performing predictive decoding) using the built-in gain codebook to obtain the gain.

Gain decoding section 1603 obtains the MDCT coefficient of the quantization target band using the obtained gain and the value of the shape inputted from shape decoding section 1602, and outputs the obtained MDCT coefficient as the third layer decoded spectrum to adder 805. The details of processing of gain decoding section 1603 will be described later.

Third layer decoding section 814 having the above configuration is operated as follows.

Demultiplexing section 1601 demultiplexes the third layer coded information into third layer band information, third layer shape coded information, third layer gain coded information, and third layer prediction information. Next, demultiplexing section 1601 outputs the obtained third layer band information, and third layer shape coded information to shape decoding section 1602, and outputs the third layer gain coded information and third layer prediction information to gain decoding section 1603.

Gain decoding section 1603 includes a built-in buffer that stores gains obtained in past frames. Furthermore, the first layer gain coded information is inputted to gain decoding section 1603 from first layer decoding section 812. Furthermore, the second layer gain coded information is inputted to gain decoding section 1603 from second layer decoding section 813. Furthermore, the third layer gain coded information and third layer prediction information are inputted to gain decoding section 1603 from demultiplexing section 1601. Furthermore, the value of the shape of the MDCT coefficient is inputted to gain decoding section 1603 from shape decoding section 1602.

Gain decoding section 1603 adaptively switches the dequantization method to one of the predictive decoding method and the non-predictive decoding method according to the third layer prediction information (Flag_PRE3).

[When Flag_PRE3=1]

In this case, gain decoding section 1603 performs predictive decoding. That is, gain decoding section 1603 predicts the gain of the current frame using gains in past frames stored in the built-in buffer to perform dequantization. To be more specific, gain decoding section 1603 incorporates a gain codebook similar to that of gain coding section 1404 of third layer coding section 218, and dequantizes the gain according to equation 36 below to obtain gain Gain_q'

(Equation 36)

$$\text{Gain_q}'(j+j'') = \sum_{t=1}^{3}\left(\alpha_t \cdot \left(C1''^{t}_{j+j''} + C2''^{t}_{j+j''} + C3''^{t}_{j+j''}\right)\right) + \alpha_0 \cdot GC3_j^{G_min} \quad (j = 0, \ldots, L-1) \quad [36]$$

Here, $C1''^{t}_{j}$ indicates the gain dequantized in first layer decoding section 812 t frames before the current frame. For example, in the case of t=1, $C1''^{1}_{j}$ indicates the gain dequantized in first layer decoding section 812 one frame before the current frame. Similarly, $C2''^{t}_{j}$ and $C3''^{t}_{j}$ indicate the gains dequantized in second layer decoding section 813 and third layer decoding section 814 respectively t frames before the current frame. Furthermore, $\alpha_0$ to $\alpha_3$ are quartic linear prediction coefficients stored in gain decoding section 1603. Gain decoding section 1603 deals with the L sub-bands in one region as the L-dimensional vector to perform vector dequantization.

In the case that the gain of the decoding target band in the past frame is not present in the built-in buffer, in equation 36 above, gain decoding section 1603 substitutes the gain of the sub-band closest to the decoding target band in the current frame in terms of the frequency among gains stored in the internal built-in buffer.

[When Flag_PRE3=0]

In this case, gain decoding section 1603 performs non-predictive decoding. That is, gain decoding section 1603 dequantizes the gain value according to equation 37 below using the above-described gain codebook. Gain decoding section 1603 also deals with the gain as the L-dimensional vector to perform the vector dequantization here. That is, in the case that the predictive decoding is not performed, Gain decoding section 1603 directly uses gain code vector $GC3_j^{G_min}$ corresponding to gain coded information G_min as the gain.

$$\text{Gain_}q'(j+j'') = GC3_j^{G_min} (j=0, \ldots, L-1) \quad \text{(Equation 37)}$$

Next, gain decoding section 1603 calculates third layer decoded spectrum (decoded MDCT coefficient) X3"(k) according to equation 38 below using the gain obtained by the dequantization of the current frame, and the value of the shape inputted from shape decoding section 1602. In the case that k exists in B(j") to B(j"+1)−1 during the dequantization of the MDCT coefficient, the gain has a value of Gain_q'(j").

(Equation 38)

$$X3''(k) = \text{Gain_q}'(j) \cdot \text{Shape_q}'(k) \quad \begin{pmatrix} k = B(j''), \ldots, B(j''+L)-1 \\ j = j'', \ldots, j''+L-1 \end{pmatrix} \quad [38]$$

Next, gain decoding section 1603 updates the built-in buffer according to equation 35.

Gain decoding section 1603 outputs third layer decoded spectrum X3"(k) calculated according to equation 38 above to adder 805.

The processing of decoding apparatus 113 has been described above.

Thus, according to the present embodiment, in the hierarchical coding scheme in which a band to be a coding target is selected in each hierarchy (layer), first layer coding section 212, second layer coding section 215, and third layer coding section 218 switch the method of encoding frequency parameters in the current layer based on the coding result in each layer in a processing frame before the current frame. When coding apparatus 111 uses a hierarchical coding scheme in which a band to be a coding target is selected in each hierarchy (layer), this makes it possible to improve the coding efficiency of frequency parameters in the current frame and, as a result, improve the quality of the decoded signal. Moreover, unlike Embodiment 1, the gain coding section in each layer performs adaptive prediction quantization using only the quantization gain in each layer or lower layer. Even in a transmission environment in which a bit rate (the number of layers) on the time axis changes, this allows the coding apparatus and the decoding apparatus to perform coding/decoding under identical conditions and thereby guarantee the coding performance.

The present embodiment has described the configuration in which the coding section in each layer calculates prediction information and transmits the prediction information. In the present embodiment, adaptive prediction determination sections 313, 613 and 1403 set prediction information using band information quantized in a processing frame one frame before the current frame and band information selected in the current frame. Here, regarding the band information and prediction information, decoding apparatus 113 can also calculate the prediction information through similar processing. Therefore, for the configuration adopting the above-described determination method, coding apparatus 111 need not transmit prediction information to decoding apparatus 113. However, the configuration in which prediction information is transmitted is effective for reducing the amount of calculation in the adaptive prediction determination section of decoding apparatus 113 as described in the present embodiment.

The embodiments of the present invention have been described so far.

The above-described embodiments have described the configuration in which the coding apparatus is configured with three coding hierarchies (layers), but the present invention is not limited to this, and is likewise applicable to configurations in which the number of layers is other than three.

Furthermore, in the case that information such as coded information is multiplexed in two consecutive steps in the above-described embodiments, the information may also be multiplexed all together in subsequent steps (e.g., two steps of multiplexing section 305 and coded information integration section 209 or the like). Furthermore, when the information such as coded information is demultiplexed in two consecutive steps, the information may also be demultiplexed all together in preceding steps (e.g., two steps of coded information demultiplexing section 801 and demultiplexing section 1601 or the like). Furthermore, when three or more signals are added up in two consecutive steps, the signals may be added up all together (e.g., two steps of adder 805 and adder 806 or the like).

Furthermore, the decoding apparatus in the above-described embodiments performs processing using coded information transmitted from the coding apparatus of the above-described embodiments, but the present invention is not limited to this. Alternatively, as long as the coded information includes the necessary parameter and data, the processing can be performed without necessarily using the coded information transmitted from the coding apparatus of the above-described embodiments.

In addition, the present invention is also applicable to cases where this signal processing program is recorded and written on a machine-readable recording medium such as memory, disk, tape, CD, or DVD, and provides behavior and effects similar to those of the present embodiment.

Also, although cases have been described in the above-described embodiments as examples where the present invention is configured by hardware, the present invention can also be realized by software. Each function block employed in the description of the above-described embodiments may typically be implemented as an LSI constituted by an integrated circuit. These may be implemented individually as single chips, or a single chip may incorporate some or all of them. Here, the term LSI has been used, but the terms IC, system LSI, super LSI, and ultra LSI may also be used according to differences in the degree of integration.

Further, the method of circuit integration is not limited to LSI, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI as a result of the advancement of semiconductor technology or a derivative other technology, it is naturally also possible to carry out function block integration using this technology. Application of biotechnology is also possible.

The disclosure of Japanese Patent Application No. 2009-259949, filed on Nov. 13, 2009, including the specification, drawings and abstract is incorporated herein by reference in its entirety.

INDUSTRIAL APPLICABILITY

The coding apparatus, decoding apparatus, and methods thereof according to the present invention can improve the quality of the decoded signal in the configuration in which the quantization target band is selected in the hierarchical manner to perform the coding/decoding. For example, the coding apparatus, decoding apparatus, and methods thereof according to the present invention can be applied to the packet communication system and the mobile communication system.

REFERENCE SIGNS LIST

101, 111 coding apparatus
102 transmission line
103, 113 decoding apparatus
201, 807 orthogonal transform processing section
202, 212 first layer coding section
203, 213, 802, 812 first layer decoding section
204, 207, 805, 806 adder
205, 215 second layer coding section
206, 216, 803, 813 second layer decoding section
208, 218 third layer coding section
209 coded information integration section
301, 601, 1401 band selecting section
302, 602, 1402 shape coding section
303, 313, 613, 1403 adaptive prediction determination section
304, 314, 603, 614, 1404 gain coding section
305, 604, 1405 multiplexing section
501, 701, 1601 demultiplexing section
502, 702, 1602 shape decoding section
503, 513, 703, 713, 1603 gain decoding section
801 coded information demultiplexing section
804, 814 third layer decoding section

The invention claimed is:

1. A coding apparatus that includes at least two coding layers, comprising:

a first layer coder that inputs an input signal of a frequency domain thereto, selects a first quantization target band of the input signal from a plurality of sub-bands into which the frequency domain is divided to obtain first band information and obtain a first gain of the input signal of the first quantization target band, generates first coded information including the first band information and first gain coded information obtained by encoding the first gain and generates a difference signal between a decoded signal obtained by performing decoding using the first coded information and the input signal; and a second layer coder that inputs the difference signal thereto, selects a second quantization target band of the difference signal from the plurality of sub-bands to obtain second band information, and obtains a second gain of the difference signal of the second quantization target band to generate second coded information including the second band information and second gain coded information obtained by encoding the second gain, wherein the first layer coder includes a determiner that determines a method of encoding the first gain from a plurality of candidates based on the first band information, and wherein encoded information is transmitted by a transmitter over a transmission line to a decoding apparatus.

2. The coding apparatus according to claim 1, wherein the determiner determines the coding method further based on the second band information.

3. The coding apparatus according to claim 1, wherein the determiner determines the coding method to be one of a predictive coding method and a non-predictive coding method based on the first band information and the second band information.

4. The coding apparatus according to claim 1, wherein the determiner determines the coding method to be one of a predictive coding method and a non-predictive coding method based on the first band information and the second band information in a past frame and the first band information and the second band information in a current frame.

5. The coding apparatus according to claim 1, wherein the determiner determines the coding method to be one of a predictive coding method and a non-predictive coding method based on the result of a comparison between a third quantization and a fourth quantization target band, the third quantization which is a union of the first quantization target band and the second quantization target band in a past frame obtained using the first band information and the second band information in the past frame and the fourth quantization target band which is a union of the first quantization target band and the second quantization target band in a current frame obtained using the first band information and the second band information in the current frame.

6. The coding apparatus according to claim 5, wherein when the result shows that the number of common sub-bands included in the third quantization target band and the fourth quantization target band is equal to or more than a predetermined threshold, the determination section determines the coding method to be the predictive coding method, and determines, when the number of common sub-bands is less than the threshold, the coding method to be the non-predictive coding method.

7. The coding apparatus according to claim 1, wherein the first layer coding section comprises:

a band selector that selects the first quantization target band of the input signal from among the plurality of sub-bands to generate the first band information and outputs the input signal of the first quantization target band; and a shape/gain coder that encodes the shape and the first gain of the input signal of the first quantization target band to generate shape coded information and the first gain coded information.

8. The coding apparatus according to claim 7, wherein the shape/gain coder encodes the first gain using the determined coding method.

9. A coding apparatus that includes at least two coding layers, comprising:

a first layer coder that inputs an input signal of a frequency domain thereto, selects a first quantization target band of the input signal from a plurality of sub-bands into which the frequency domain is divided to obtain first band information and obtain a first gain of the input signal of the first quantization target band, generates first coded information including the first band information and first gain coded information obtained by encoding the first gain and generates a difference signal between a decoded signal obtained by performing decoding using the first coded information and the input signal; and a second layer coding section that inputs the difference signal thereto, selects a second quantization target band of the difference signal from the plurality of sub-bands to obtain second band information, and obtains a second gain of the difference signal of the second quantization target band to generate second coded information including the second band information and second gain coded information obtained by encoding the second gain, wherein at least one of the first layer coder and the second layer coder includes a determiner that determines a method of encoding a gain of an input signal to the coder of the each layer in a quantization target band of each layer from a plurality of candidates based on band information in an own layer or a lower layer, wherein encoded information is transmitted by a transmitter over a transmission line to a decoding apparatus.

10. The coding apparatus according to claim 9, wherein the determiner determines the coding method to be one of a predictive coding method and a non-predictive coding method based on band information in the own layer or a lower layer.

11. The coding apparatus according to claim 9, wherein the determiner determines the coding method to be one of a predictive coding method and a non-predictive coding method based on band information in the own layer or a lower layer out of the first band information and the second band information in a past frame and the first band information and the second band information in a current frame.

12. The coding apparatus according to claim 9, wherein the determiner determines the coding method to be one of a predictive coding method and a non-predictive coding method based on the result of a comparison between a third quantization target band and a fourth quantization target band, the third quantization target band which is a union of band information in the own layer or a lower layer of the first quantization target band and the second quantization target band in the past frame obtained using band information in the own layer or a lower layer of the first band information and the second band information in the past frame, and the fourth quantization target band which is a union of band information in the own layer or a lower layer of the first quantization target band and the second quantization target band in the current frame obtained using band information in the own layer or a lower layer of the first band information and the second band information in the current frame.

13. The coding apparatus according to claim 9, wherein the determiner determines the coding method to be a predictive coding method when the result shows that the number of common sub-bands included in the third quantization target band and the fourth quantization target band is equal to or more than a predetermined threshold, and determines the coding method to be a non-predictive coding method when the number of common sub-bands is less than the threshold.

14. A communication terminal apparatus, comprising:

the coding apparatus according to claim 1.

15. A base station apparatus, comprising:

the coding apparatus according to claim 1.

16. A decoding apparatus that receives and decodes information generated by a coding apparatus including at least two coding layers, comprising:

a receiver that receives the information including first coded information and second coded information, the first coded information being obtained by encoding a first layer of the coding apparatus, the first coded information including first band information generated by selecting a first quantization target band of the first layer from a plurality of sub-bands into which a frequency domain is divided, the second coded information being obtained by encoding a second layer of the coding apparatus using the first coded information, the second coded information including second band information generated by selecting a second quantization target band of the second layer from the plurality of sub-bands;

a first layer decoder that inputs the first coded information obtained from the information thereto, and generates a first decoded signal with respect to the first quantization target band set based on the first band information; and a second layer decoder that inputs the second coded information obtained from the information thereto, and generates a second decoded signal with respect to the second quantization target band set based on the second band information, wherein the first layer decoder includes a determiner that determines a method of decoding a gain of the first decoded signal from a plurality of candidates based on the first band information, and wherein the first coded information and the second coded information is received by the receiver over a transmission line to a coding apparatus.

17. The decoding apparatus according to claim 16, wherein the determiner determines the decoding method further based on the second band information.

18. The decoding apparatus according to claim 16, wherein the determiner determines the decoding method to be one of a predictive decoding method and a non-predictive decoding method based on the first band information and the second band information.

19. The decoding apparatus according to claim 16, wherein the determiner determines the decoding method to be a predictive decoding method and a non-predictive decoding method based on the first band information and the second band information in a past frame and the first band information and the second band information in a current frame.

20. The decoding apparatus according to claim 16, wherein the determiner determines the decoding method to be one of a predictive decoding method and a non-predictive decoding method based on the result of a comparison between a third quantization target band and a fourth quantization target band, the third quantization target which is a union of the first quantization target band and the second quantization target band in a past frame obtained using the first band information and the second band information in the past frame and the fourth quantization target band which is a union of the first quantization target band and the second quantization target band in a current frame obtained using the first band information and the second band information in the current frame.

21. The decoding apparatus according to claim 20, wherein when the result shows that the number of common sub-bands included in the third quantization target band and the fourth quantization target band is equal to or more than a predetermined threshold, the determiner determines the decoding method to be the predictive decoding method, and determines, when the number of common sub-bands is less than the threshold, the decoding method to be the non-predictive decoding method.

22. The decoding apparatus according to claim 16, wherein the receiver receives the first coded information further comprising determination information that determines whether or not predictive coding is used as a method of encoding a gain in the first quantization target band obtained through encoding of the first layer of the coding apparatus, and the determiner determines the decoding method to be one of a predictive decoding method and a non-predictive decoding method further based on the determination information.

23. A communication terminal apparatus, comprising:

the decoding apparatus according to claim 16.

24. A base station apparatus, comprising:

the decoding apparatus according to claim 16.

25. A coding method including at least two coding layers, comprising:

inputting, in a first encoding layer, an input signal of a frequency domain thereto, selecting a first quantization target band of the input signal from a plurality of sub-bands into which the frequency domain is divided to obtain first band information, while obtaining a first gain of the input signal of the first quantization target band, generating first coded information including the first band information and first coded information obtained by encoding the first gain, and generating a difference signal between a decoded signal obtained by performing decoding using the first coded information and the input signal; and inputting, in a second encoding layer, the difference signal, selecting a second quantization target band of the difference signal from the plurality of sub-bands to obtain second band information, while obtaining a second gain of the difference signal of the second quantization target band and generating second coded information including the second band information and second gain coded information obtained by encoding the second gain, wherein the first encoding layer includes determining a method of encoding the first gain from a plurality of candidates based on the first band information, and wherein encoded information is transmitted by a transmitter over a transmission line from an encoding apparatus to a decoding apparatus.

26. A decoding method for receiving and decoding information generated by a coding apparatus including at least two coding layers, comprising:

receiving the information including first coded information and second coded information, the first coded information being obtained by encoding a first layer of the coding apparatus, the first coded information including first band information generated by selecting a first quantization target band of the first layer from a plurality of sub-bands into which a frequency domain is divided, the second coded information being obtained by encoding a second layer of the coding apparatus using the first coded information, the second coded information including second band information generated by selecting a second quantization target band of the second layer from the plurality of sub-bands;

inputting, in a first layer decoding, the first coded information obtained from the information thereto, and generating a first decoded signal with respect to the first quantization target band set based on the first band information; and inputting, in a second layer decoding, the second coded information obtained from the information thereto, and generating a second decoded signal with respect to the second quantization target band set based on the second band information, wherein the first layer decoding includes determining a method of decoding a gain of the first decoded signal from a plurality of candidates based on the first band information, and wherein encoded information transmitted from an encoding apparatus over a transmission line is received by a decoding apparatus.

* * * * *